US008330065B2

(12) United States Patent
Ohda et al.

(10) Patent No.: US 8,330,065 B2
(45) **Date of Patent: *Dec. 11, 2012**

(54) SWITCHGEAR AND SWITCHGEAR OPERATING MECHANISM

(75) Inventors: Yoshiaki Ohda, Kanagawa (JP); Masaharu Shimizu, Kanagawa (JP); Satoshi Marushima, Kanagawa (JP); Hirokazu Takagi, Kanagawa (JP); Yoshikata Kobayashi, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 393 days.

This patent is subject to a terminal disclaimer.

(21) Appl. No.: 12/694,874

(22) Filed: Jan. 27, 2010

(65) Prior Publication Data

US 2010/0126967 A1 May 27, 2010

Related U.S. Application Data

(63) Continuation-in-part of application No. PCT/JP2008/001994, filed on Jul. 25, 2008.

(30) Foreign Application Priority Data

Jul. 27, 2007 (JP) ..... 2007-195992

(51) Int. Cl.
*H01H 3/00* (2006.01)

(52) U.S. Cl. ..... 200/400; 200/318; 218/154

(58) Field of Classification Search ..... 218/7, 14, 218/153, 154; 335/8–10, 21, 22, 26–29, 335/167–171, 189–192; 200/400, 401, 500, 200/501, 318, 321–327, 335–337
See application file for complete search history.

(56) References Cited

U.S. PATENT DOCUMENTS 3,600,541 A * 8/1971 Goodwin, Jr. ..... 200/400
4,114,005 A * 9/1978 Maier et al. ..... 200/400
(Continued)

FOREIGN PATENT DOCUMENTS

JP 11-213824 8/1999
(Continued)

OTHER PUBLICATIONS

U.S. Appl. No. 12/868,416, filed Aug. 25, 2010, Marushima, et al.

*Primary Examiner* — Amy Cohen Johnson
*Assistant Examiner* — Marina Fishman
(74) *Attorney, Agent, or Firm* — Oblon, Spivak, McClelland, Maier & Neustadt, L.L.P.

(57) ABSTRACT

The time period is shortened till a cutoff spring force is released when a switchgear is cut off. This switchgear comprises: a closing shaft; a main lever fixed turnably on the closing shaft and associated with a movable contact; a closing spring; a sub shaft; a sub lever and a latch lever fixed on the sub shaft; a roller mounted on the leading end of the latch lever; a turnable latch and a kick lever; a lock lever made turnable with respect to the latch; a latch returning spring for biasing the latch; a lock returning spring for biasing the kick lever and the lock lever; and a stopper for restricting the turns of the lock lever and the latch.

21 Claims, 16 Drawing Sheets

U.S. PATENT DOCUMENTS

| | | | | | |
|---|---|---|---|---|---|
| 4,301,436 | A * | 11/1981 | Castonguay et al. | 335/166 | |
| 4,404,446 | A * | 9/1983 | Maier et al. | 200/320 | |
| 4,968,861 | A * | 11/1990 | Kuhn | 200/400 | |
| 5,113,056 | A * | 5/1992 | Kuhn | 200/400 | |
| 6,472,627 | B1 * | 10/2002 | Yoon | 200/400 | |
| 7,449,653 | B2 * | 11/2008 | Gibson et al. | 200/400 | |
| 7,772,513 | B2 * | 8/2010 | Ohda et al. | 200/400 | |

FOREIGN PATENT DOCUMENTS

| | | |
|---|---|---|
| JP | 2000-040445 | 2/2000 |
| JP | 2007-087836 | 4/2007 |
| JP | 2007-294363 | 11/2007 |
| JP | 2008-091098 | 4/2008 |
| WO | WO 99/10906 | 3/1999 |

* cited by examiner

SWITCHGEAR AND SWITCHGEAR OPERATING MECHANISM

CROSS REFERENCES TO RELATED APPLICATIONS

This application is a continuation-in-part (CIP) application of International Application PCT/JP2008/001994, the entire content of which is incorporated herein by reference. This application is based upon and claims the benefit of priority from the prior Japanese Patent Application No. 2007-195992, filed in the Japanese Patent Office on Jul. 27, 2007, the entire content of which is incorporated herein by reference.

BACKGROUND OF THE INVENTION

The present invention relates to a switchgear for opening/closing an electrical circuit and its operating mechanism and, more particularly, to a switchgear and its operating mechanism suitably configured for cutting off high-voltage current in short time periods.

In general, there are available, as an operating mechanism of a switchgear, one using a hydraulic operating force for large power and one using a spring operating force for middle/small output power. The former is referred to as "hydraulic operating mechanism" and the latter as "spring operating mechanism". In recent years, the advancement of size reduction of an arc-extinguishing chamber of a gas-insulated circuit breaker which is a type of a switchgear allows fault current to be cut off with a smaller operating force, so that application of the spring operating mechanism becomes popular. However, a gas-insulated circuit breaker of extra high-voltage class requires high-speed operating capability called "2-cycle operation" that is capability of achieving cutoff within a time length corresponding to two-cycle time periods of alternating current. A conventional spring operating mechanism typically has operating capability equivalent to about 3-cycle operation, and it is not easy to realize the two-cycle cutoff capability due to poor responsiveness of a retention mechanism or retention control mechanism of a spring force.

A first type of conventional example of an operating mechanism of such a switchgear is disclosed in Japanese Patent Application Laid-Open Publications No. 11-213824 (FIGS. 1 and 7) and No. 2000-40445 (FIGS. 1 and 3), the entire contents of which are incorporated herein by reference. In operation mechanisms disclosed in these documents, a force of a cutoff spring is retained by a retention mechanism constituted by a latch, O-prop (opening-hook lever), and a catch through an output lever. In this configuration, when a trip current is applied to a solenoid serving as a retention control mechanism, a plunger of the solenoid activates the catch to allow the engagement between the catch and prop to be released, which releases the engagement between the output lever and the latch to rotate the output lever to release the cutoff spring force, thereby achieving cutoff operation.

A second type of conventional example of the switchgear operating mechanism is disclosed in Japanese Patent No. 3497866 (FIGS. 1 to 4), the entire content of which is incorporated herein by reference. In a spring operating mechanism disclosed in this document, a pull-out lever and a retention lever are provided for retaining a cutoff spring force. In this configuration, the retention lever is activated not by the cutoff spring force but by a force of an acceleration spring at the cutoff operation time so as to release the cutoff spring force.

In the first type of conventional example of the switchgear operating mechanism, operation for releasing the cutoff spring force (cutoff operation) is constituted by the following three steps: operation of the catch driven by excitation of the solenoid, operation of the O-prop, and operation of electrical contacts including the cutoff spring. The operational relationship between the above components is illustrated in FIG. 16. The horizontal axis denotes time, and vertical axis denotes a stroke of each components. In FIG. 16, the lowermost curve represents the waveform of a trip current and, above this, the stroke of the catch is depicted. Above this, the strokes of the O-prop and the cutoff spring are depicted. The uppermost curve represents an energizing signal of the contact in an arc-extinguishing chamber of a gas-insulated circuit breaker.

Time length from the start of application of the trip current until the operation of the O-prop is started along with the operation of the catch is assumed to be T1. Time length from the start of operation of the O-prop to the start of operation of the cutoff spring is assumed to be T2. Time length from the start of operation of the cutoff spring until the cutoff spring reaches its contact opening point is assumed to be T3. Assuming that contact opening time is T0, $$T0=T1+T2+T3 \quad (1)$$

is satisfied.

In order to realize 2-cycle operation, it is necessary to reduce contact opening time T0 to a given value. Thus, in a typical spring operating mechanism, operations of the components from the catch to the cutoff spring, which occur after the trip current application, are not started simultaneously. That is, the catch operates to some degree to release the engagement between itself and the O-prop to thereby allow operation of the O-prop to be started, and the cutoff spring starts operating after the O-prop operates to some degree. Thus, a mechanism that-retains a cutoff spring force operates in a stepwise manner, so that it is necessary to reduce respective time lengths T1, T2, and T3 in order to reduce T0.

However, since the cutoff spring force is determined by the weight of a movable portion of the arc-extinguishing chamber, opening speed, and drive energy, there is a limit to a reduction of T3. With regard to T2, weight reduction of the O-prop and increase in a force (retention force) of retaining the cutoff spring force allow high-speed operation of the O-prop. However, when the retention force is increased, the size of the O-prop needs to be increased for strength, which limits the weight reduction of the O-prop. It follows that there occurs a limit in the improvement in operation speed relying on the increase in the retention force. Further, when the retention force is increased, a large force is applied to the engagement portion between the O-prop and the catch, so that there occurs a need to increase the size of the catch for strength and to provide a solenoid having a large electromagnetic power for activating the catch.

At present, an excitation method using a large-sized condenser is adopted for obtaining a large power of the solenoid. However, the upper limit value for a current value flowing to the solenoid is specified in the standard, so that there is a limit in the improvement in the output power of the solenoid. As described above, it is difficult to reduce the contact opening time in the conventional spring operating mechanism.

Also in the second type of conventional example, operation for releasing the cutoff spring force is constituted by the following three steps: operation of a pull-off hook driven by an electromagnet; simultaneous operation of a reset lever, acceleration spring, and a retention lever; and simultaneous operation of a pull-off lever and a cutoff spring. In this example, the direction of a retention force (pressuring force) of the cutoff spring is made substantially coincident with the rotation center of the retention lever, thereby reducing a force required for the operation of the retention lever.

Further, the speed of movement of the retention lever, which is included in the above second step, is made higher by the accelerating spring to thereby reduce the operation time. However, it is physically difficult to reduce the operation time of the second step to zero and, therefore, it is difficult to significantly reduce the entire contact opening time, also in terms of the problems described in the first example.

Further, the direction of a pressuring force to a portion at which the pull-off lever and the retention lever are engaged with each other is made substantially coincident with the rotation center of the retention lever, so that when an external vibration is applied to the retention lever to force the same to vibrate, the pull-off lever is rotated in the cutoff operation direction, and the cutoff operating mechanism may start operating without a cutoff command.

Further, the direction of the pressuring force may fluctuate with respect to the rotation center of the retention lever due to deformation of the engagement surface between a roller provided on the pull-off lever and the retention lever, so that when the pressuring force acts in the cutoff operation direction of the retention lever, the pull-off lever may be released without a cutoff command.

Further, although not described in Japanese Patent No. 3497866, it is just conceivable that the retention lever operates in the cutoff direction due to an impact force applied when the roller pushes aside the retention lever for reengagement in the closing operation to allow the cutoff operation to be started without a cutoff command. As described above, in the second example, it is difficult to significantly reduce the contact opening time and it is likely that a retention state of the cutoff spring becomes unstable.

The present invention has been made to solve the above problems, and an object thereof is to provide a switchgear for opening/closing an electrical circuit and its operating mechanism in which retention/release of the cutoff spring force is performed by a combination of a latch and its lock mechanism to reduce a time period for the cutoff spring force to be released so as to significantly reduce the entire contact opening time and, at the same time, stability and reliability of a retention state of the cutoff spring force are improved.

BRIEF SUMMARY OF THE INVENTION

In order to achieve the object, according to an aspect of the present invention there is provided a switchgear operating mechanism for reciprocatively driving a movable contact of a switchgear so as to shift the switchgear between a cutoff state and a closed state, the operating mechanism comprising: a frame; a closing shaft which is rotatably disposed relative to the frame; main lever which is rotatably fixed to the closing shaft and which can be swung in conjunction with the movable contact; a cutoff spring which is disposed such that it accumulates energy when the switchgear operating state is shifted from the cutoff state to the closed state in accordance with rotation of the closing shaft while it discharges its accumulated energy when the switchgear operating state is shifted from the closed state to the cutoff state; a sub-shaft which is rotatably disposed relative to the frame so as to be positioned around a rotation axis substantially parallel to a rotation axis of the closing shaft; a sub-lever which is swingably fixed to the sub-shaft; a main-sub connection link which rotatably connects a leading end of the sub-lever and the main lever; a cam mechanism which swings the sub-shaft in accordance with a rotation of the closing shaft; a latch lever which is swingably fixed to the sub-shaft; a roller which is rotatably fixed to a leading end of the latch lever; a latch which is disposed so as to be rotated relative to the frame around a rotation axis substantially parallel to the rotation axis of the closing shaft; a kick lever which is disposed so as to be rotated relative to the latch around a rotation axis substantially parallel to the rotation axis of the latch and has a through hole therein; a lock lever which is disposed so as to be rotated relative to the latch around a different rotation axis substantially parallel to the rotation axis of the latch; a latch return spring which biases the latch so as to rotate the latch in a predetermined direction; a lock return spring which biases the lock lever and the kick lever so as to rotate the lock lever and the kick lever in a predetermined direction; stopper which is fixed to the frame so as to restrict the rotation of the biasing direction of the lock lever and the latch; and a connection pin which is attached to the lock lever so as to be moved and rotated in the through hole formed in the lock lever relative to the through hole, wherein in the closed state, the roller pushes the leading end of the latch in an opposite direction to the biasing direction of the latch return spring and causes the leading end of the lock lever to be engaged with the stopper to stop the operation of the latch, and in a state where the switchgear operating state is shifted from the closed state to the cutoff state, the lock lever is pulled so as to be rotated in an opposite direction to the biasing direction of the lock return spring and the latch is pulled in an opposite direction to the biasing direction of the latch return spring to release an engagement between the roller and the leading end of the latch, which causes the cutoff spring to discharge its energy to rotate the sub-shaft and the main lever.

According to another aspect of the present invention there is provided a switchgear operating mechanism for reciprocatively driving a movable contact of a switchgear so as to shift the switchgear between a cutoff state and a closed state, the operating mechanism comprising: a frame; a closing shaft which is rotatably disposed relative to the frame; a main lever which is rotatably fixed to the closing shaft and which can be swung in conjunction with the movable contact; a cutoff spring which is disposed such that it accumulates energy when the switchgear operating state is shifted from the cutoff state to the closed state in accordance with rotation of the closing shaft while it discharges its accumulated energy when the switchgear operating state is shifted from the closed state to the cutoff state; a sub-shaft which is rotatably disposed relative to the frame so as to be positioned around a rotation axis substantially parallel to a rotation axis of the closing shaft; a sub-lever which is swingably fixed to the sub-shaft; a main-sub connection link which rotatably connects a leading end of the sub-lever and the main lever; a cam mechanism which swings the sub-shaft in accordance with a rotation of the closing shaft; a latch lever which is swingably fixed to the sub-shaft; a roller which is rotatably fixed to a leading end of the latch lever; a latch which is disposed so as to be rotated relative to the frame around a rotation axis substantially parallel to the rotation axis of the closing shaft; a lock lever which is disposed so as to be rotated relative to the frame around a rotation axis substantially parallel to the rotation axis of the latch; a latch return spring which biases the latch so as to rotate the latch in a predetermined direction; a lock lever return spring which biases the lock lever in a direction opposite to the biasing direction of the latch return spring; and a stopper which is fixed to the frame so as to restrict the rotation of the biasing direction of the lock lever return spring of the lock lever, wherein in the closed state, the roller pushes the leading end of the latch in a direction opposite to the biasing force of the latch return spring, and in a state where the switchgear operating state is shifted from the closed state to the cutoff state, the lock lever is pulled so as to allow the latch to be rotated in an opposite direction to the biasing direction of the latch return spring to release an engagement between the roller and the leading end of the latch, which causes the cutoff spring to discharge its energy to rotate the sub-shaft.

According to another aspect of the present invention there is provided a switchgear having a movable contact that can be moved in a reciprocating manner and an operating mechanism that reciprocatively drives the movable contact and configured to be shifted between a cutoff state and a closed state by the movement of the movable contact, the operating mechanism comprising: a frame; a closing shaft which is rotatably disposed relative to the frame; a main lever which is rotatably fixed to the closing shaft and which can be swung in conjunction with the movable contact; a cutoff spring which is disposed such that it accumulates energy when the switchgear operating state is shifted from the cutoff state to the closed state in accordance with rotation of the closing shaft while it discharges its accumulated energy when the switchgear operating state is shifted from the closed state to the cutoff state; a sub-shaft which is rotatably disposed relative to the frame so as to be positioned around a rotation axis substantially parallel to a rotation axis of the closing shaft; a sub-lever which is swingably fixed to the sub-shaft; a main-sub connection link which rotatably connects a leading end of the sub-lever and the main lever; a cam mechanism which swings the sub-shaft in accordance with a rotation of the closing shaft; a latch lever which swingably fixed to the sub-shaft; a roller which is rotatably fixed to a leading end of the latch lever; a latch which is disposed so as to be rotated relative to the frame around a rotation axis substantially parallel to the rotation axis of the closing shaft; a kick lever which is disposed so as to be rotated relative to the latch around a rotation axis substantially parallel to the rotation axis of the latch; a lock lever which is disposed so as to be rotated relative to the latch around a different rotation axis substantially parallel to the rotation axis of the latch; a latch return spring which biases the latch so as to rotate the latch in a predetermined direction; a lock return spring which biases the lock lever and the kick lever so as to rotate the lock lever and the kick lever in a predetermined direction; a stopper which is attached to the frame so as to restrict the rotation of the biasing direction of the lock lever and the latch; and a hole disposed in the kick lever so as to be engaged with a pin disposed on the lock lever, wherein in the closed state, the roller pushes the leading end of the latch in an opposite direction to the biasing direction of the latch return spring and causes the leading end of the lock lever to be engaged with the stopper to stop the operation of the latch, and in a state where the switchgear operating state is shifted from the closed state to the cutoff state, the lock lever is pulled so as to allow the lock lever to be rotated in an opposite direction to the biasing direction of the lock return spring and the latch is pulled in an opposite direction to the biasing direction of the latch return spring to release an engagement between the roller and the leading end of the latch, which causes the cutoff spring to discharge its energy to rotate the sub-shaft and the main lever.

According to another aspect of the present invention there is provided a switchgear having a movable contact that can be moved in a reciprocating manner and an operating mechanism that reciprocatively drives the movable contact and configured to be shifted between a cutoff state and a closed state by the movement of the movable contact, the operating mechanism comprising: a frame; a closing shaft which is rotatably disposed relative to the frame; a main lever which is rotatably fixed to the closing shaft and which can be swung in conjunction with the movable contact; a cutoff spring which is disposed such that it accumulates energy when the switchgear operating state is shifted from the cutoff state to the closed state in accordance with rotation of the closing shaft while it discharges its accumulated energy when the switchgear operating state is shifted from the closed state to the cutoff state; a sub-shaft which is rotatably disposed relative to the frame so as to be positioned around a rotation axis substantially parallel to a rotation axis of the closing shaft; a sub-lever which is swingably fixed to the sub-shaft; a main-sub connection link which rotatably connects a leading end of the sub-lever and the main lever; a cam mechanism which swings the sub-shaft in accordance with a rotation of the closing shaft; a latch lever which swingably fixed to the sub-shaft; a roller which is rotatably fixed to a leading end of the latch lever; a latch which is disposed so as to be rotated relative to the frame around a rotation axis substantially parallel to the rotation axis of the closing shaft; a lock lever which is disposed so as to be rotated relative to the frame around a rotation axis substantially parallel to the rotation axis of the latch; a latch return spring which biases the latch so as to rotate the latch in a predetermined direction; a lock lever return spring which biases the lock lever in a direction opposite to the biasing direction of the latch return spring; and a stopper which is fixed to the frame so as to restrict the rotation of the biasing direction of the lock lever return spring of the lock lever, wherein in the closed state, the roller pushes the leading end of the latch in a direction opposite to the biasing force of the latch return spring, and in a state where the switchgear operating state is shifted from the closed state to the cutoff state, the lock lever is pulled so as to allow the latch to be rotated in an opposite direction to the biasing direction of the latch return spring to release an engagement between the roller and the leading end of the latch, which causes the cutoff spring to discharge its energy to rotate the sub-shaft.

BRIEF DESCRIPTION OF THE DRAWINGS

The above and other features and advantages of the present invention will become apparent from the discussion hereinbelow of specific, illustrative embodiments thereof presented in conjunction with the accompanying drawings, in which.

DETAILED DESCRIPTION OF THE INVENTION

Embodiments of an operating mechanism of a switchgear according to the present invention will be described below with reference to the accompanying drawings.

First Embodiment

Figure 1:
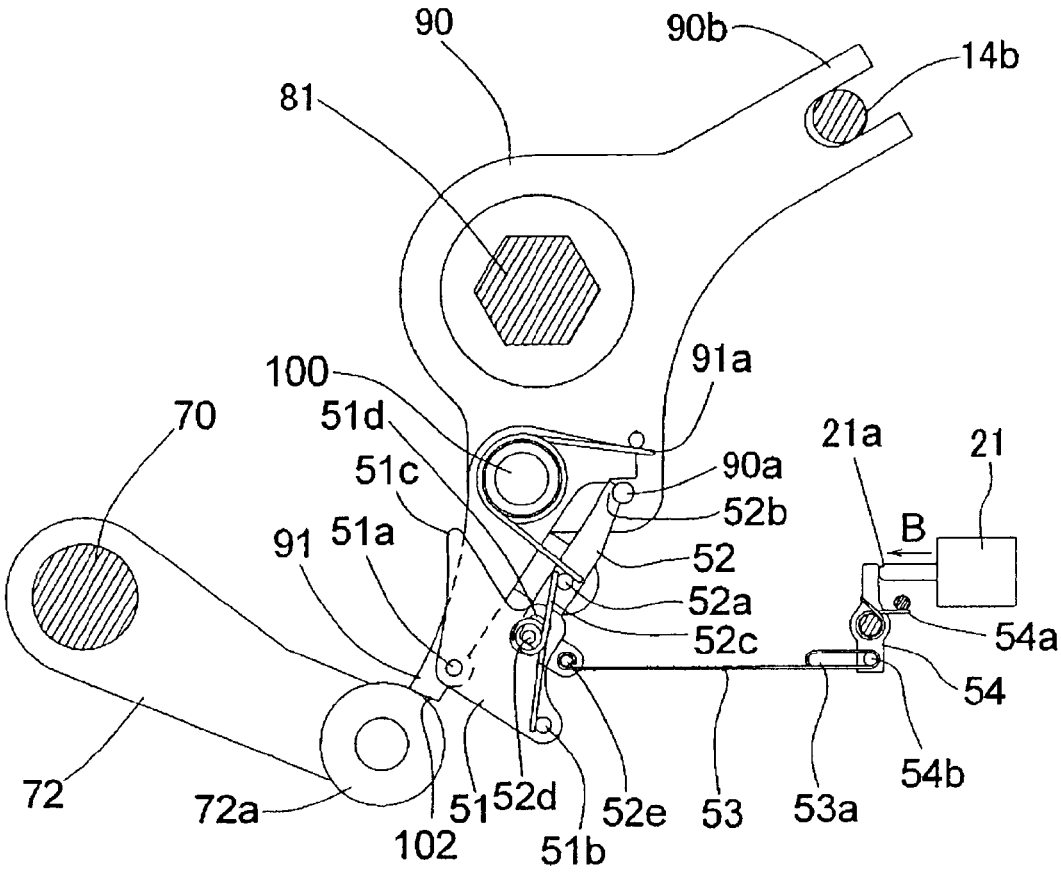
FIG. 1 is a front view illustrating a closed state of a retention unit and a retention control unit of a switchgear operating mechanism according to a first embodiment of the present invention.
Figure 2:
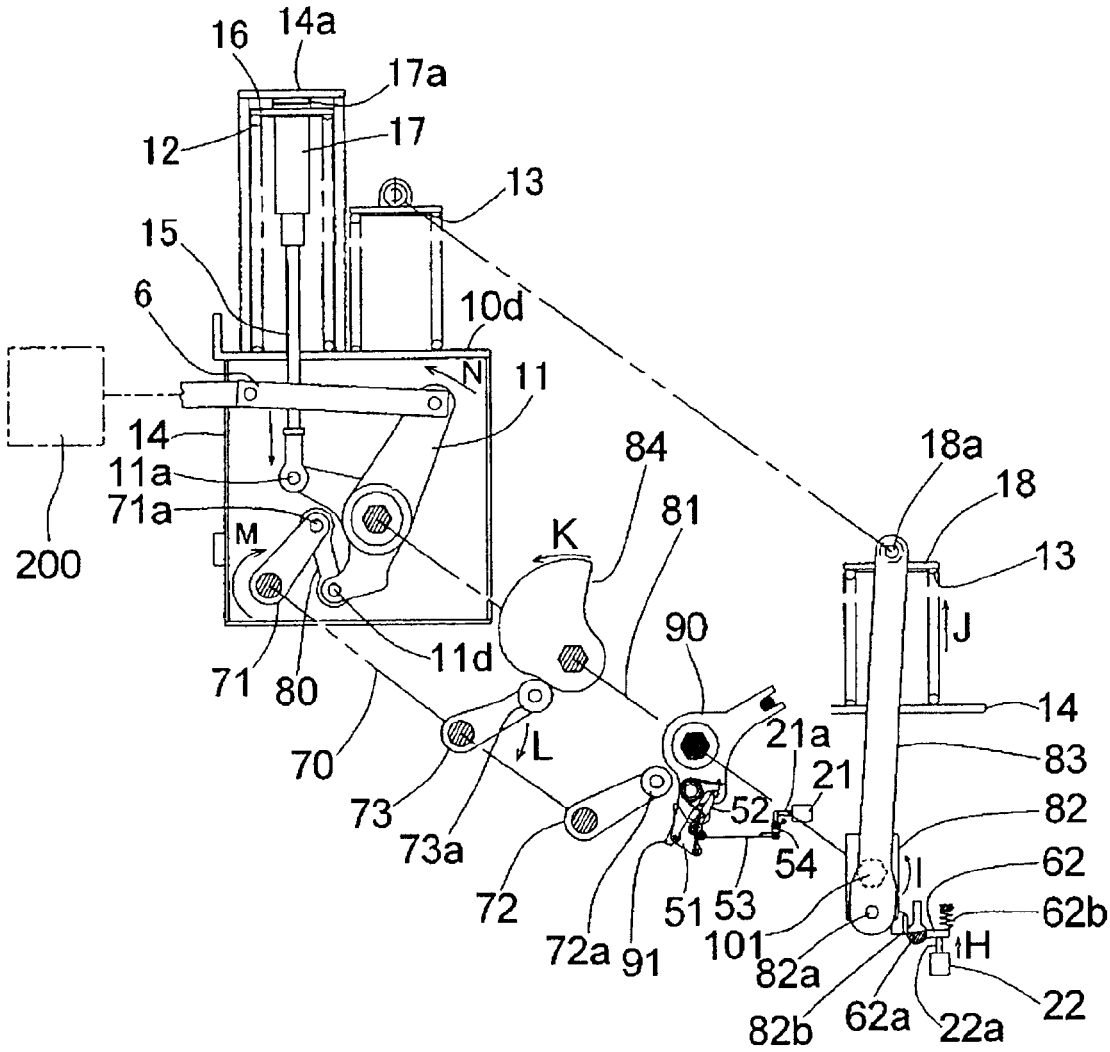
FIG. 2 is a developed front view illustrating a cutoff state of the spring operating mechanism of the switchgear illustrated in FIG. 1.
Figure 3:
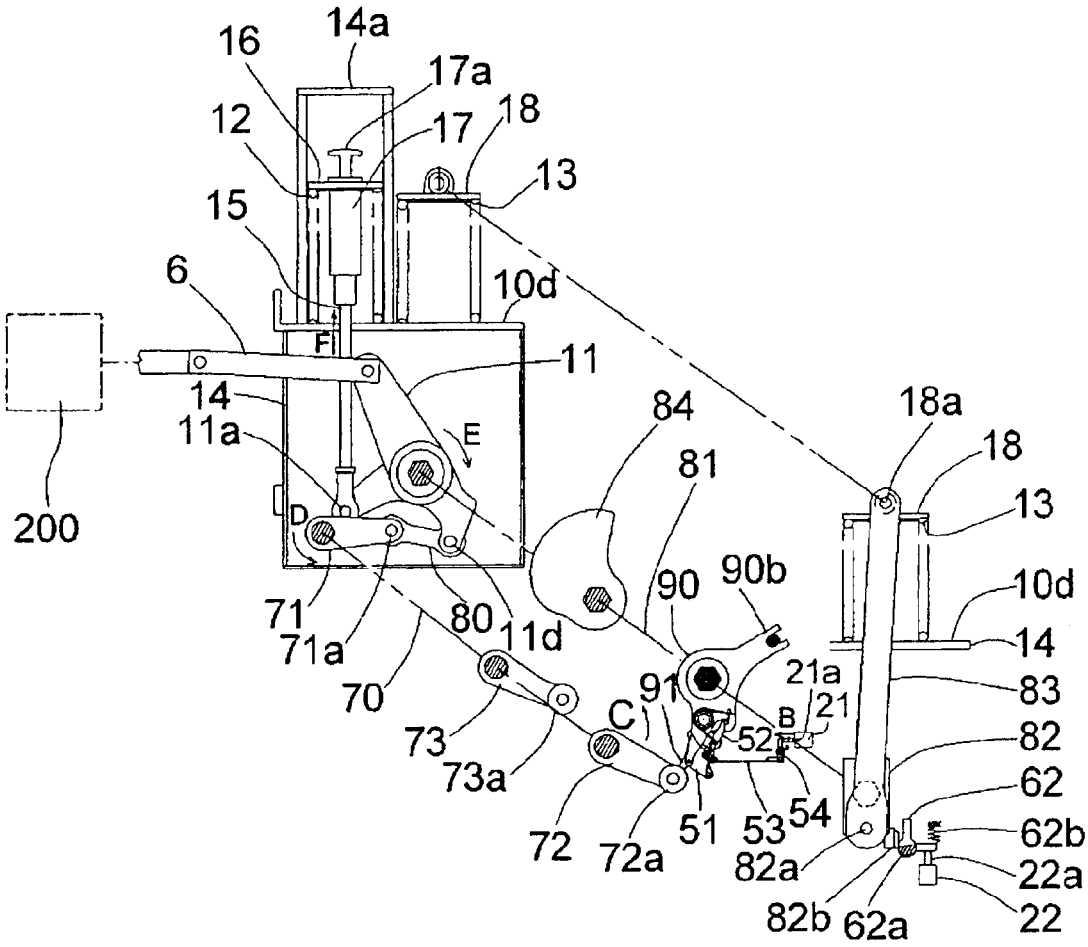
FIG. 3 is a developed front view illustrating a closed state of the spring operating mechanism of the switchgear illustrated in FIG. 1.
Figure 4:
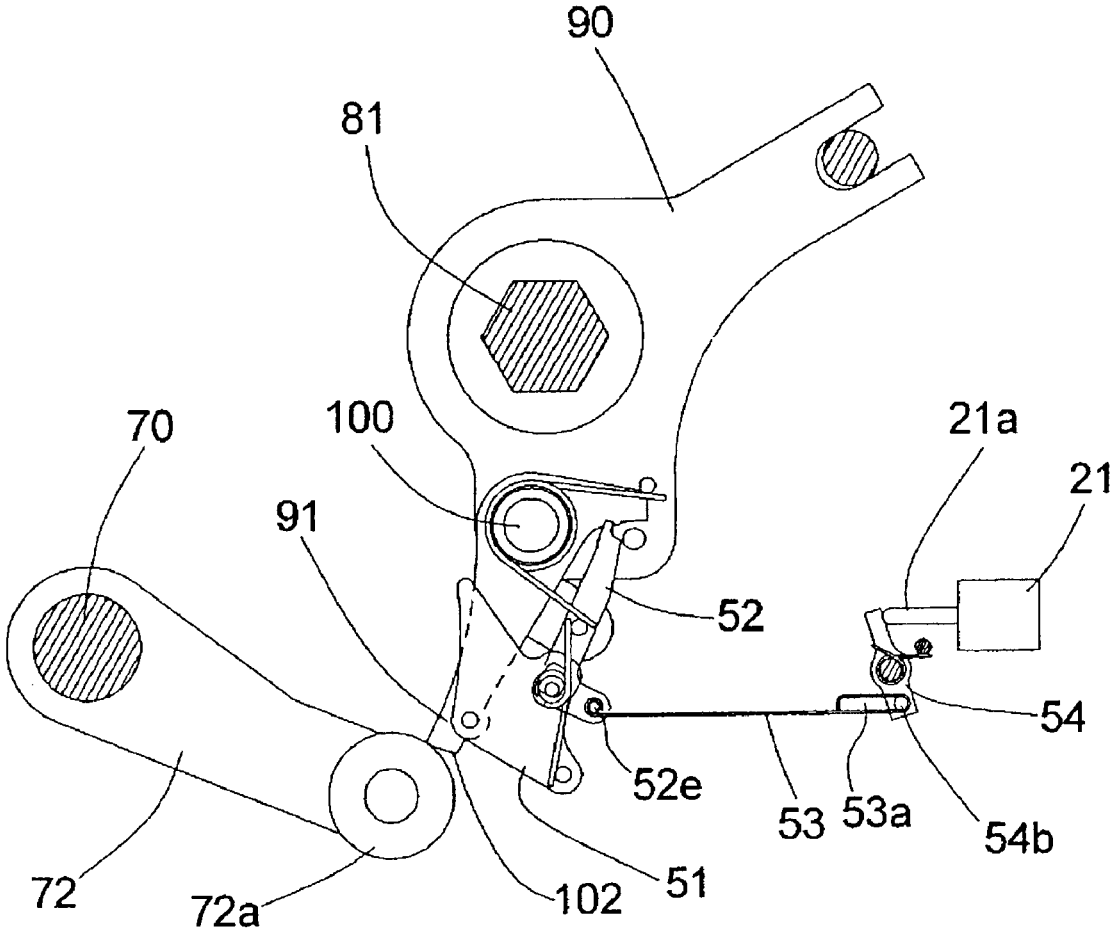
FIG. 4 is a front view of the main part of the switchgear of FIG. 1, which illustrates a cutoff operation process from the closed state to the cutoff state.
Figure 5:
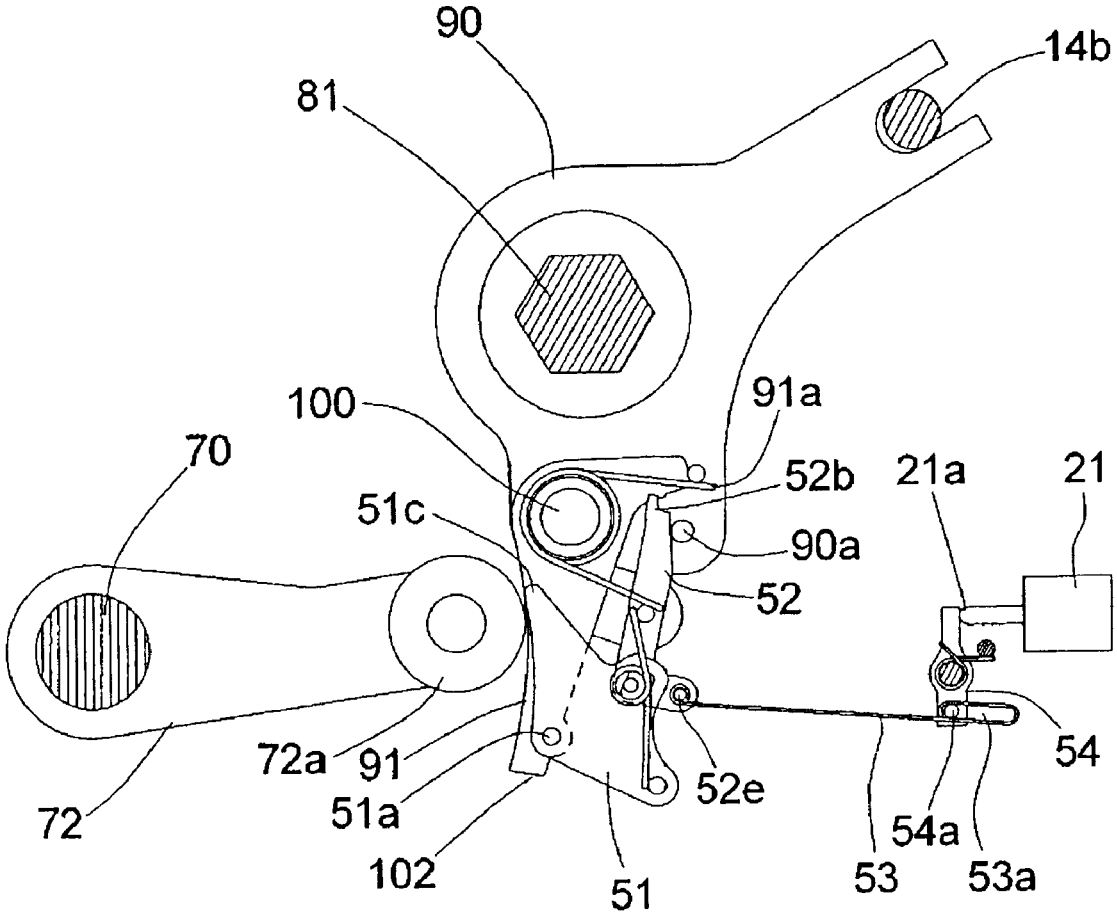
FIG. 5 is a front view of the main part of the switchgear of FIG. 1, which illustrates a cutoff operation process continued from FIG. 4.
Figure 6:
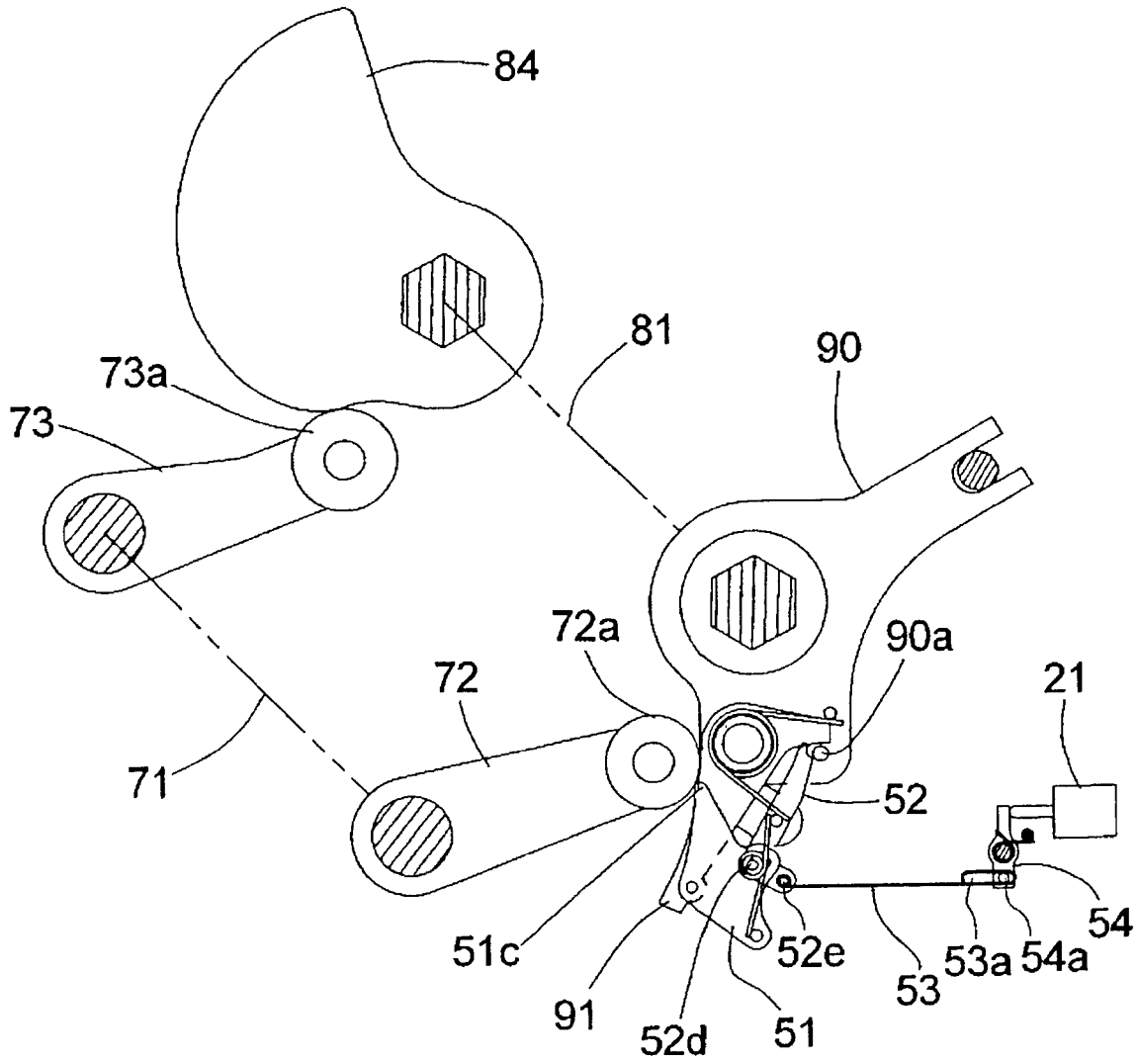
FIG. 6 is a front view of the main part of the switchgear of FIG. 1, which illustrates a closing operation process from the cutoff state to the closed state.
Figure 7:
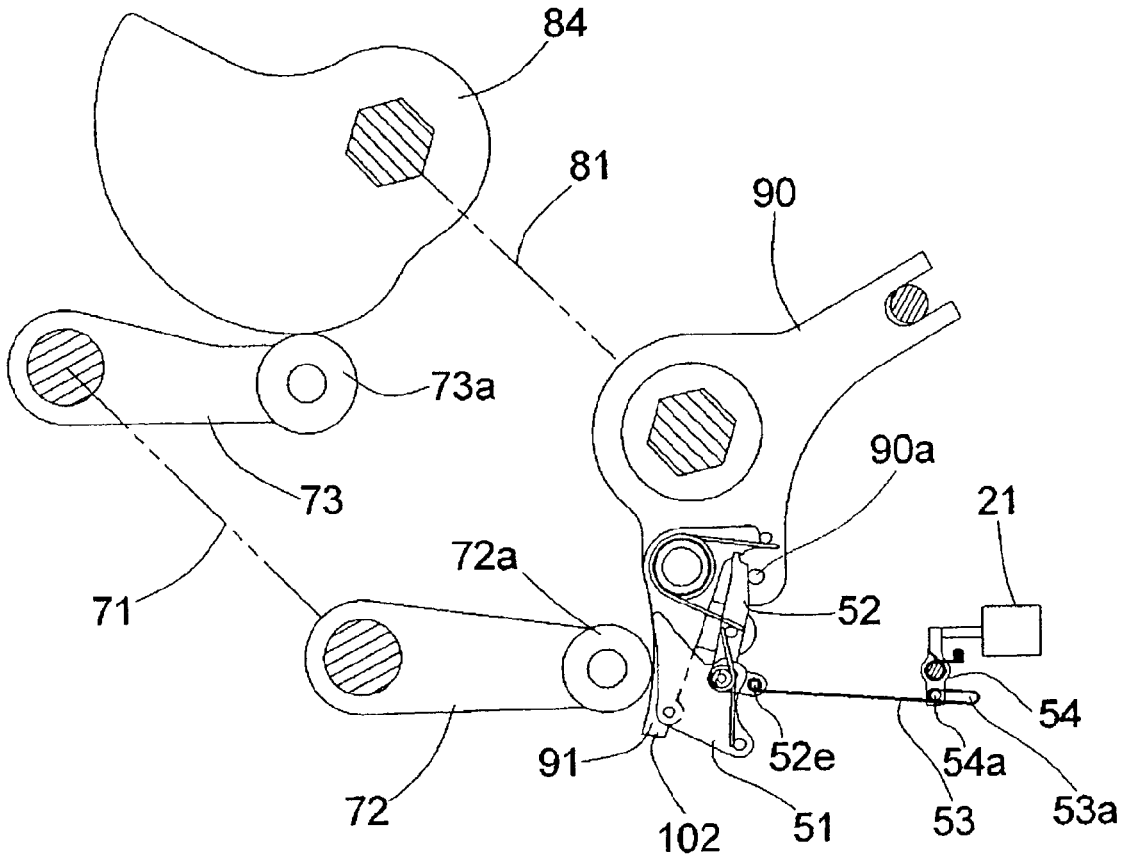
FIG. 7 is a front view of the main part of the switchgear of FIG. 1, which illustrates a closing operation process continued from FIG. 6.

First, with reference to FIGS. 1 to 7, a first embodiment of a switchgear operating mechanism according to the present invention will be described. FIG. 1 is a front view illustrating a closed state of a retention unit and a retention control unit of a switchgear operating mechanism. FIG. 2 is a view illustrating a cutoff state of a spring operating mechanism including the units illustrated in FIG. 1. FIG. 3 is a view illustrating a closed state of a spring operating mechanism including the units illustrated in FIG. 1. FIGS. 4 and 5 are views illustrating a cutoff operation process from the closed state to the cutoff state. FIGS. 6 and 7 are views illustrating a closing operation process from the cutoff state to the closed state.

In FIGS. 2 and 3, a movable contact 200 is connected to the left side of a link mechanism 6. When the link mechanism 6 is moved in the right direction as illustrated in FIG. 2, the movable contact 200 becomes "open" to achieve a cutoff state. On the other hand, when the link mechanism 6 is moved in the left direction as illustrated in FIG. 3, the movable contact 200 becomes "closed" to achieve a closed state. One end of the link mechanism 6 is rotatably engaged with the leading end of a main lever 11, and the main lever 11 is rotatably fixed to a closing shaft 81. The closing shaft 81 is rotatably supported by a bearing (not illustrated) fixed to a frame (support structure) 14.

A cutoff spring 12 has one end fixed to an attachment surface 10*d* of the frame 14 and the other end fitted to a cutoff spring receiver 16. A damper 17 is fixed to the cutoff spring receiver 16. In the damper 17, a fluid is encapsulated and a piston 17*a* is provided so as to translationally slide. One end of the damper 17 is fixed to a cutoff spring link 15, which is rotatably attached to a pin 11*a* of the main lever 11.

A sub-shaft 70 is rotatably disposed relative to the frame 14, and a sub-lever 71 is fixed to the sub-shaft 70. A pin 71*a* is disposed at the leading end of the sub-lever 71. A pin 11*d* disposed on the main lever 11 and the pin 71*a* are connected by a main-sub connection link 80. A latch lever 72 is fixed to the sub-shaft 70, and a roller 72*a* is rotatably fitted to the leading end of the latch lever 72. Further, a cam lever 73 is fixed to the sub-shaft 70, and a roller 73*a* is rotatably fitted to the leading end of the cam lever 73.

A closing spring 13 has one end fixed to an attachment surface 10*d* of the frame 14 and the other end fixed to a closing spring receiver 18. A pin 18*a* is disposed on the closing spring receiver 18. The pin 18*a* is connected to a pin 82*a* of a closing lever 82 which is fixed to the end portion of the closing shaft 81 through a closing link 83. A closing cam 84 is fixed to the closing shaft 81 and releasably engaged with the roller 73*a* in accordance with the rotation of the closing shaft 81.

A tab 82*b* is disposed at one end of the closing lever 82 and is releasably engaged with a half-column portion 62*a* provided in an anchoring lever 62 for closing which is rotatably disposed relative to the frame 14. Further, a return spring 62*b* is disposed at one end of the anchoring lever 62 for closing. The other end of the return spring 62*b* is fixed to the frame 14. The return spring 62*b* is a compression spring and the spring force thereof always acts on the anchoring lever 62 for closing as a clockwise torque. However, the rotation of the anchoring lever 62 is restricted by an engagement between a plunger 22*a* of an electromagnetic solenoid 22 for closing which is fixed to the frame 14 and the anchoring lever 62 for closing.

In the cutoff state illustrated in FIG. 2, a center 101 of the closing shaft 81 is displaced to the left relative to the center axis (or the axis connecting the centers of the pin 18*a* and the pin 82*a*) of the closing link 83, so that a counterclockwise torque is applied to the closing lever 82 by the closing spring 13. However, the rotation of the closing lever 82 is retained by an engagement between the tab 82*b* and the half-column portion 62*a*.

A two-forked support portion 90*b* is formed at the leading end of an anchoring lever 90. The support portion 90*b* is engaged with a stopper 14*b* which is fixed to the frame 14, which fixes the position of the anchoring lever 90 relative to the frame 14.

A latch 91 is rotatably disposed around a latch axis pin 100 which is fixed to the end portion of the anchoring lever 90. A latch return spring 91*a* is disposed between the anchoring lever 90 and the latch 91. The latch return spring 91*a* always generates a clockwise torque for the latch 91. The clockwise rotation of the latch 91 is restricted by an abutment between a stopper pin (stopper) 90*a* disposed on the anchoring lever 90 and the latch 91. A leading end 102 of the latch 91 is formed by a substantially cylindrical surface, and the center axis position of the cylindrical surface falls within a range between the rotation center of the latch 91, (i.e., center axis of the latch axis pin 100) and position spaced from the center axis of the latch axis pin 100 on the stopper 90*a* side by a distance corresponding to the radius of the latch axis pin 100.

A kick lever 51 is rotatably disposed around a rotary shaft 51*a* which is fixed to the latch 91. A protrusion portion 51*c* to be described later is formed in the kick lever 51. Further, a substantially rectangular through hole 51*d* is formed in the kick lever 51.

A lock lever 52 is rotatably disposed around a rotary shaft 52*a* which is fixed to the latch 91. A connection pin 52*d* is disposed on the lock lever 52, and the kick lever 51 and the lock lever 52 are connected to each other through an engagement between the connection pin 52*d* and a through hole 51*d*. The through hole 51*d* has a size allowing the connection pin 52*d* to move and rotate to some degree in the through hole 51*d* relative to the same.

A lock return spring 52*c* is disposed around the connection pin 52*d*. The lock return spring 52*c* has one end anchored to the rotary shaft 52*a* and the other end anchored to a pin 51*b* disposed on the kick lever 51 and always generates a clockwise torque for the lock lever 52. For the kick lever 51, the lock return spring 52*c* always generates a counterclockwise torque.

A torque generated by the lock return spring 52*c* is restricted by an abutment between a cut portion 52*b* formed at one end of the lock lever 52 and the stopper 90*a*. The rotation of the kick lever 51 is restricted by an abutment between the through hole 51*d* and the connection pin 52*d*. In the closed state illustrated in FIG. 1, the connection pin 52*d* abuts the side surface of the through hole 51*d* at the rotary shaft 51*a* side. This causes the direction of a contact force between the connection pin 52*d* and the through hole 51*d* to be directed toward the rotary shaft 52*a*.

Since the cut portion 52*b* is engaged with the stopper pin 90*a* in the closed state illustrated in FIGS. 1 and 3, the counterclockwise rotation of the latch 91 is restricted. A protrusion portion 51*c* is formed in the kick lever 51, and it is releasably engaged with the roller 72*a*.

A pull-off link mechanism has a pull-off link 53 and a pull-off lever 54 rotatably and translationally engaged with one end of the pull-off link 53. A pin 52*e* disposed on the lock lever 52 and the end portion of the pull-off link 53 is connected in a rotatable manner. The pull-off link 53 has an elongated hole 53*a* at the engagement portion with the pull-off lever 54. A pin 54*b* is disposed on the pull-off lever 54. The pin 54*b* is engaged with the elongated hole 53*a*, allowing the pin 54*b* and the elongated hole 53*a* to be moved and rotated relative to each other within the range of the elongated hole 53*a*. The pull-off lever 54 is rotatably disposed relative to the frame 14 and always receives a clockwise torque by a pull-off return spring 54*a*.

The leading end of a plunger 21*a* of an electromagnetic solenoid 21 for cutoff which is fixed to the frame 14 is releasably engaged with the pull-off lever 54, which restricts the torque of the pull-off return spring 54*a* and causes the pull-off lever 54 to be rotated in the counterclockwise direction upon input of a cutoff command.

In the closed state, the main lever 11 always receives a clockwise torque by an expanding spring force of the cutoff spring 12. The force transmitted to the main lever 11 is then transmitted to the sub-lever 71 through the main-sub connection link 80. The transmitted force becomes a torque for always rotating the sub-lever 71 in the counterclockwise direction. This counterclockwise torque is supplied also to the latch lever 72. However, in the closed state, the leading end 102 of the latch 91 and the roller 72*a* are engaged with each other to restrict the counterclockwise rotation of the latch lever 72. Accordingly, the subsequent members from the sub-lever 71 to the cutoff spring 12 maintain their static state.

In the present embodiment, the rotation shafts, such as the closing shaft 81 and the sub-shaft 70, and axes of the respective pins are parallel to each other.

(Cutoff Operation)

In the present embodiment having the configuration described above, a cutoff operation from the closed state illustrated in FIGS. 1 and 3, through states illustrated in FIGS. 4 and 5, to the cutoff state illustrated in FIG. 2 will be described below. First, in the closed state illustrated in FIGS. 1 and 3, upon input of an external command, the electromagnetic solenoid 21 for cutoff is excited to move the plunger 21*a* in the direction of an arrow B. Since the pull-off lever 54 is engaged with the plunger 21*a*, it is rotated in the counterclockwise direction. In conjunction with the rotation, the elongated hole 53*a* is moved to the right while being engaged with the pin 54*b* to rotate the lock lever 52 in the counterclockwise direction. This state is illustrated in FIG. 4.

The pull-off link 53 rotates the latch 91 in the counterclockwise direction through the lock lever 52, which releases an engagement between the roller 72*a* and the leading end 102 of the latch 91. The latch lever 72 receives a counterclockwise torque from the cutoff spring 12, so that it is rotated in the counterclockwise direction while pushing the latch 91. At this time, the elongated hole 53*a* moves along the pin 54*b*, so that the pull-off link 53 and the pull-off lever 54 operate independently of each other. In this state, the protrusion portion 51*c* of the kick lever 51 has been moved to the pull-off lever 54 side by the rotation of the lock lever 52, so that it is not engaged with the roller 72*a*. This state is illustrated in FIG. 5.

FIG. 2 illustrates the end state of the cutoff operation. In this state, the kick lever 51 and the lock lever 52 have been returned to substantially the same position as those in the closed state (FIGS. 1 and 3) by the lock return spring 52*c* (FIG. 1). Further, the pull-off link 53 and the pull-off lever 54 have been returned to substantially the same position as those in the closed state by the pull-off return spring 54*a*. Furthermore, the latch 91 has been returned to substantially the same position as that in the closed state by the latch return spring 91*a*.

When an engagement between the latch 91 and the roller 72*a* is released in FIG. 3, the cam lever 73 and the sub-lever 71, which are fixed to the latch lever 72 and the sub-shaft 70, are rotated in the counterclockwise direction (denoted by arrows C and D). Then, the main lever 11 is rotated in the clockwise direction (denoted by an arrow E) to cause the cutoff spring 12 and damper 17 to be moved in the direction of an arrow F. Then, the link mechanism 6 and the movable contact 200 connected to the link mechanism 6 are moved to the right to start the cutoff operation.

When the cutoff spring 12 is displaced by a given distance, the piston 17*a* abuts the stopper 14*a* fixed to the frame 14 to generate a braking power of the damper 17 to thereby stop the movement of the cutoff spring 12. The movements of the link levers connected to the cutoff spring 12 are accordingly stopped, thereby completing the cutoff operation. This state is illustrated in FIG. 2.

(Closing Operation)

Next, a closing operation from the cutoff state illustrated in FIG. 2, through states illustrated in FIGS. 6 and 7, to the closed state illustrated in FIGS. 1 and 3 will be described.

FIG. 2 illustrates the cutoff state where the closing spring 13 has accumulated energy. Upon input of an external command, the electromagnetic solenoid 22 for closing is excited to move the plunger 22*a* in the direction of an arrow H. The anchoring lever 62 for closing is engaged with the plunger 22*a*, so that it is rotated in the counterclockwise direction. Then, the engagement between the half-column portion 62*a* and the tab 82*b* is released. Accordingly, the closing lever 82 and the closing shaft 81 are rotated in the counterclockwise direction (denoted by an arrow I) by a spring force of the closing spring 13. The closing spring 13 is stretched in the direction of an arrow J and discharges its accumulated energy. The closing cam 84 fixed to the closing shaft 81 is rotated in the direction of an arrow K to be engaged with the roller 73*a*. When the roller 73*a* is pushed by the closing cam 84, the cam lever 73 is rotated in the clockwise direction (denoted by an arrow L) and, at the same time, the sub-lever 71 is rotated in the direction of an arrow M.

When the rotation of the sub-lever 71 is transmitted to the main lever 11, the main lever 11 is rotated in the counterclockwise direction (denoted by an arrow N). Then, the link mechanism 6 and the movable contact 200 connected to the link mechanism 6 are moved to the left to start the closing operation. The cutoff spring 12 is compressed in association with the rotation of the main lever 11 to accumulate energy to establish an engagement between the roller 72*a* and the latch 91 once again, thereby completing the closing operation.

When the latch lever 72 is rotated in the clockwise direction in a state where the operation is shifted from the cutoff state illustrated in FIG. 2 to the closing operation, the roller 72*a* is engaged with the protrusion portion 51*c* of the kick lever 51 in the first place. This engagement causes the kick lever 51 to be rotated in the clockwise direction and, accordingly, the side surface of the through hole 51*a* on the latch 91 side is engaged with the connection pin 52*d* to thereby cause the lock lever 52 to be rotated in the counterclockwise direction. This releases an engagement between the lock lever 52 and the stopper 90*a*, allowing the counterclockwise rotation of the latch 91. This state is illustrated in FIG. 6.

FIG. 7 illustrates a state where the latch 91 is rotated further in the counterclockwise direction by the roller 72*a*. FIGS. 1 and 3 illustrate a state where the closing operation has been completed.

When an engagement between the closing cam 84 and the roller 73*a* is released, the latch 91 is returned to substantially the same position as that in the closed state by the torque of the latch return spring 91*a*. At this time, the lock lever 52 and the kick lever 51 are also returned to substantially the same position as those in the closed state by the torque clue to the lock return spring 52*c*. Further, the roller 72*a* is engaged with the leading end 102 of the latch 91 once again by the expanding force of the cutoff spring 12. At this reengagement operation, a force acting from the roller 72*a* to the latch 91 is directed to a range between substantially the rotation center of the latch 91 and position spaced from the rotation center of the latch 91 on the stopper 90*a* side by a distance corresponding to the radius of the latch axis pin 100. This is because that the leading end 102 of the latch 91 is formed by a substantially cylindrical surface, and the center position of the cylindrical surface falls within a range between substantially the rotation center of the latch 91, (i.e., center of the latch axis pin 100) and position spaced from the rotation center of the latch axis pin 100 on the stopper 90*a* side. Therefore, the latch 91 is pressed to rotate in the counterclockwise direction. However, the counterclockwise rotation of the latch 91 is restricted because the cut portion 52*b* of the lock lever 52 is engaged with the stopper 90*a*. Thus, a mechanism for locking the latch 91 is achieved.

According to the present embodiment, after the electromagnetic solenoid 21 for cutoff is excited upon input of a cutoff command, the cutoff operation is completed by two operation steps: a first operation step in which the latch 91 is directly driven through the pull-off lever 54, the pull-off link 53 and the lock lever 52 to release an engagement between the latch 91 and the roller 72*a*; and a second operation step in which the cutoff spring 12 operates. As described above, the number of operation steps for completing the cutoff operation is reduced from three (in the case of conventional spring operating mechanism) to two, thereby significantly reducing the cutoff operation time. This means that T2 is removed from the expression (1) representing the contact opening time, so that it is possible to reduce the contact opening time.

Further, the engagement surface of the leading end 102 of the latch 91 is formed by a substantially cylindrical surface, and the center position of the cylindrical surface falls within a range between substantially the rotation center of the latch, (i.e., center of the latch axis pin 100) and position spaced from the rotation center of the latch axis pin 100 on the stopper 90*a* side by a distance corresponding to the radius of the latch axis pin 100, so that a torque of the roller 72*a* acting on the latch 91 in the closed state becomes small. This allows a reduction of the size and the weight of the latch 91 and the lock lever 52 to thereby minimize a force required for releasing its engagement, which can minimize the size of the electromagnetic solenoid.

Further, by forming the protrusion portion 51*c* in the kick lever 51 and engaging the protrusion portion 51*c* with the roller 72*a* at the time of the closing, it is possible to realize an action for easily releasing an engagement between the lock lever 52 and the stopper 90*a* with a simple structure, contributing to size reduction of the latch 91.

The elongated hole 53*a* is disposed at one end of the pull-off link 53, and the pin 54*b* disposed on the pull-off lever 54 and the elongated hole 53*a* are engaged with each other. This configuration allows an engagement between the pull-off link 53 and the pull-off lever 54 to be released at the time when the latch 91 is returned to the closing state. As a result, it is possible to minimize the weight of the movable portion of the latch 91 to thereby reduce the time required for the latch 91 to return to the position of the closed state, enabling high speed operation.

There is a possibility that the connection pin 52*d* may abut the though hole 51*d* at the time when the kick lever 51 returns to the position of the closed state to apply an abutment force on the lock lever 52 to generate a torque in the lock lever 52. However, the connection pin 52*d* abuts the side surface of the through hole 51*d* at its rotary shaft 51*a* side, so that the abutment force is directed to the center of the rotary shaft 52*a*, preventing a torque from being generated.

Second Embodiment

Figure 8:
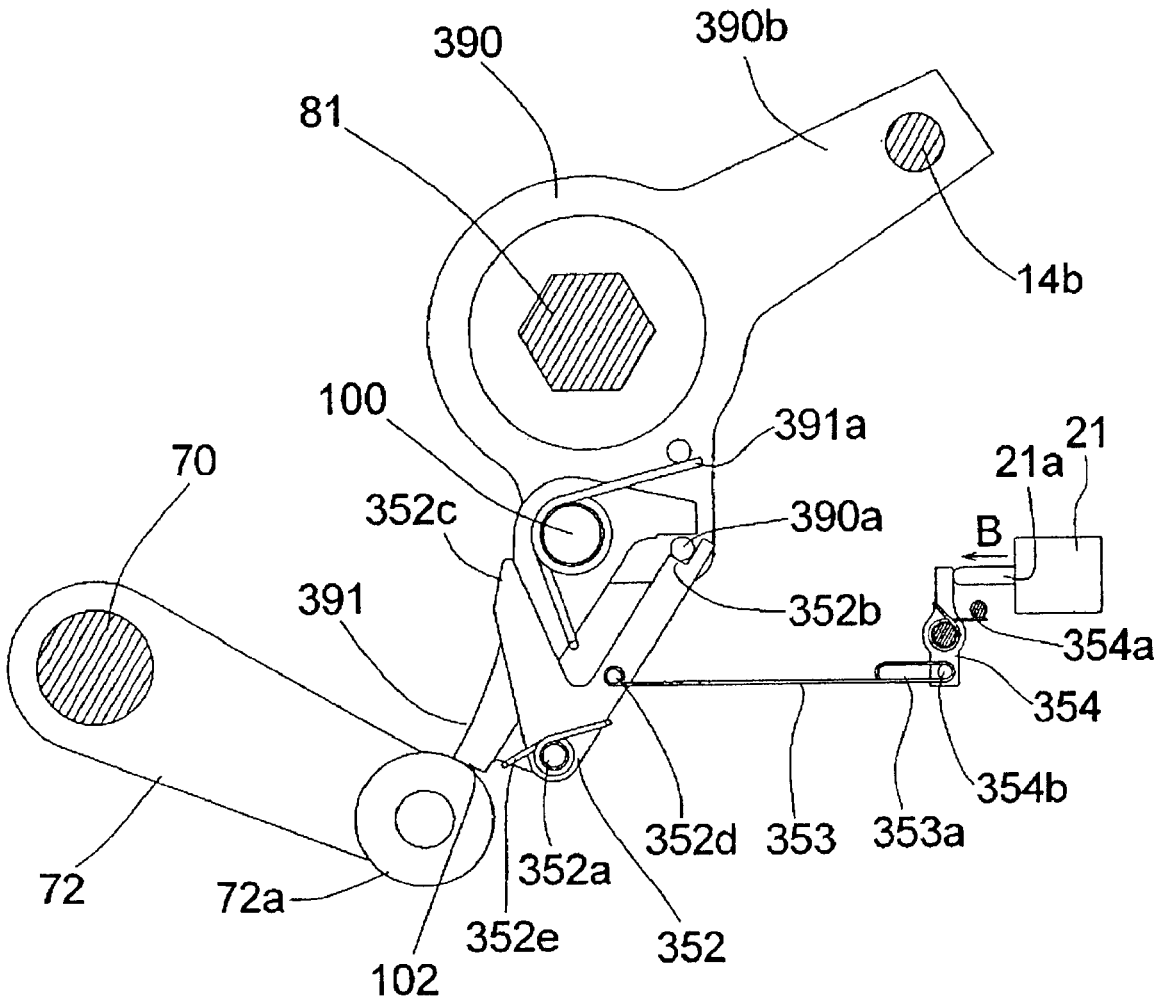
FIG. 8 is a front view illustrating a closed state of a retention unit and a retention control unit of a switchgear operating mechanism according to a second embodiment of the present invention.
Figure 9:
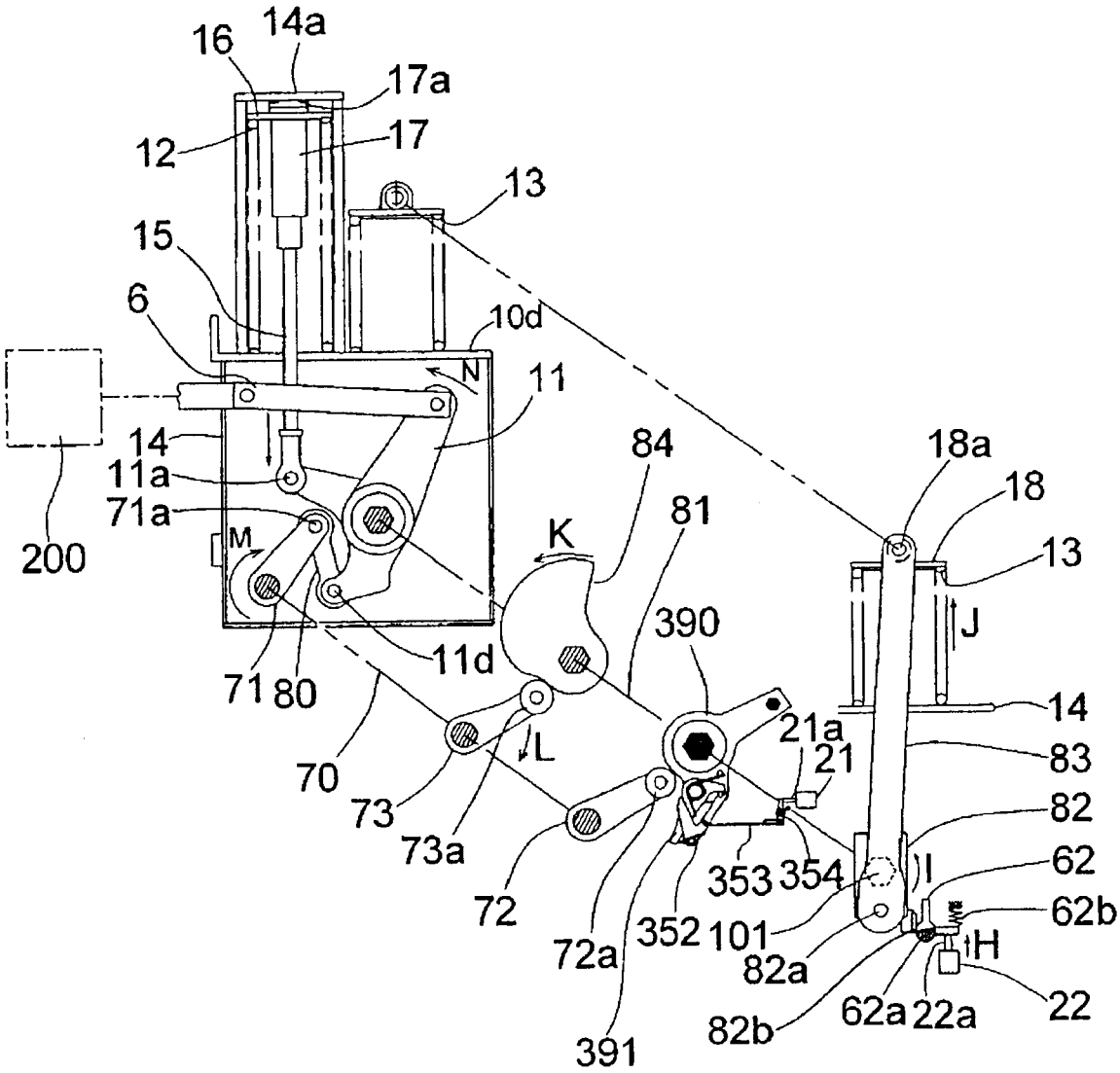
FIG. 9 is a developed front view illustrating a cutoff state of the spring operating mechanism of the switchgear illustrated in FIG. 8.
Figure 10:
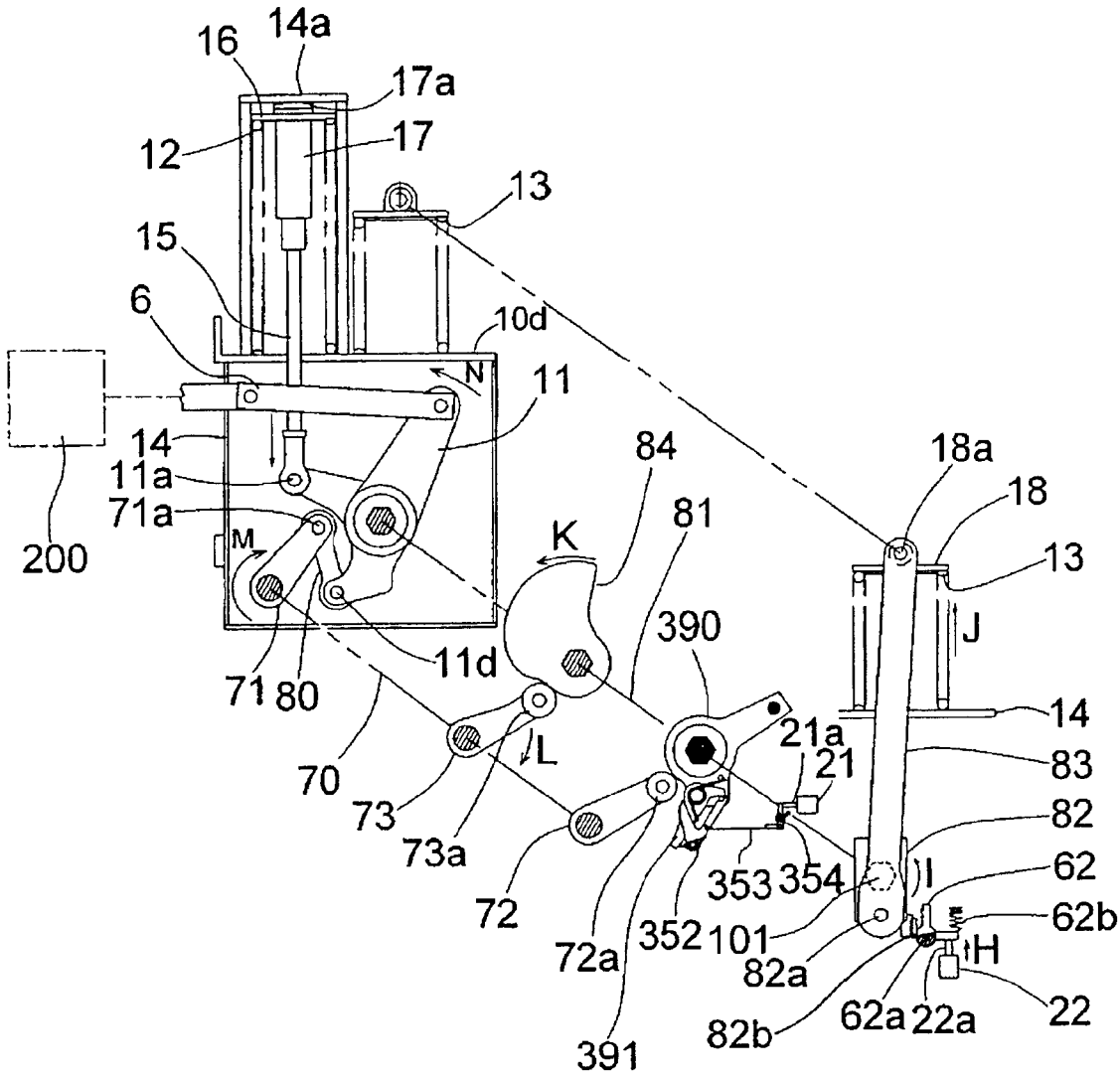
FIG. 10 is a developed front view illustrating a closed state of the spring operating mechanism of the switchgear illustrated in FIG. 8.
Figure 11:
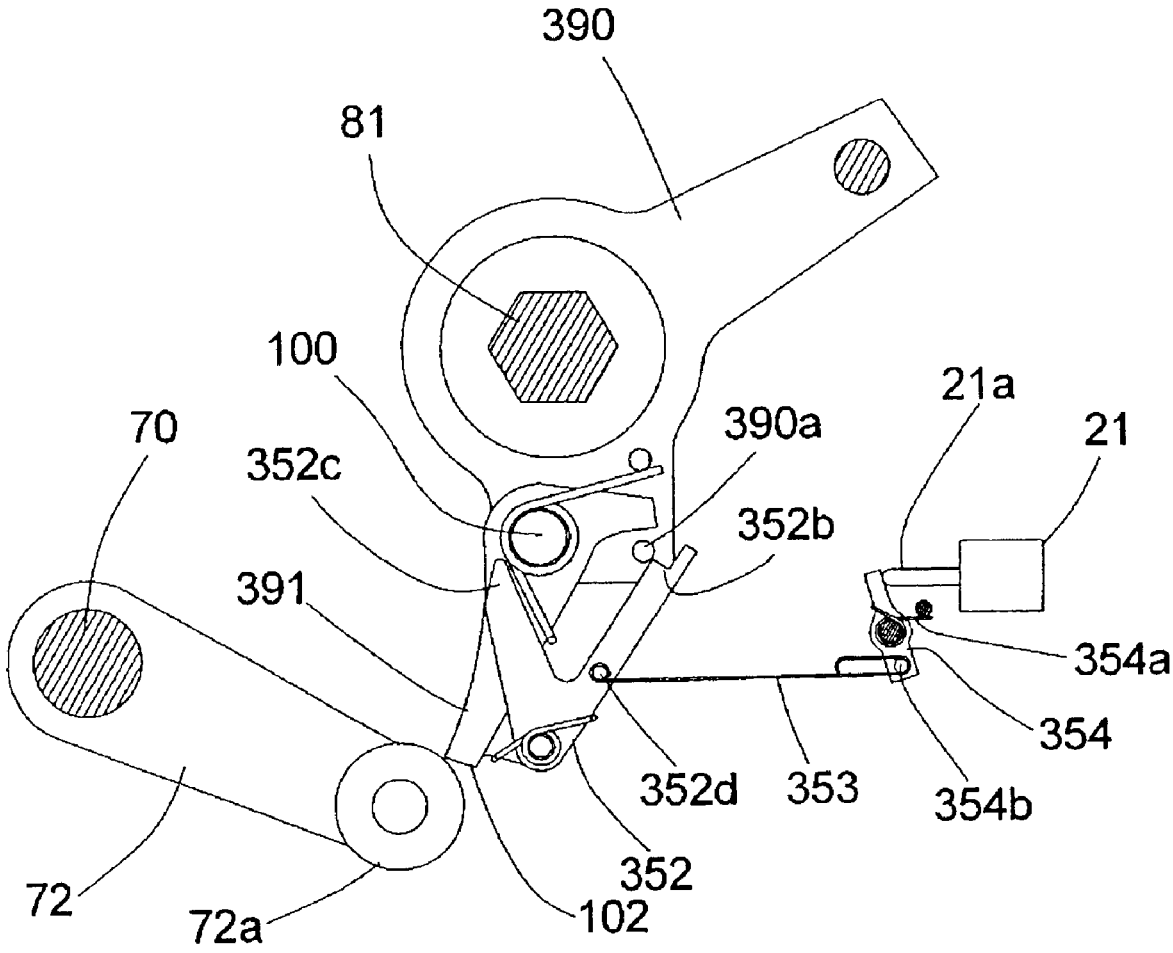
FIG. 11 is a front view of the main part of the switchgear of FIG. 8, which illustrates a cutoff operation process from the closed state to the cutoff state.
Figure 12:
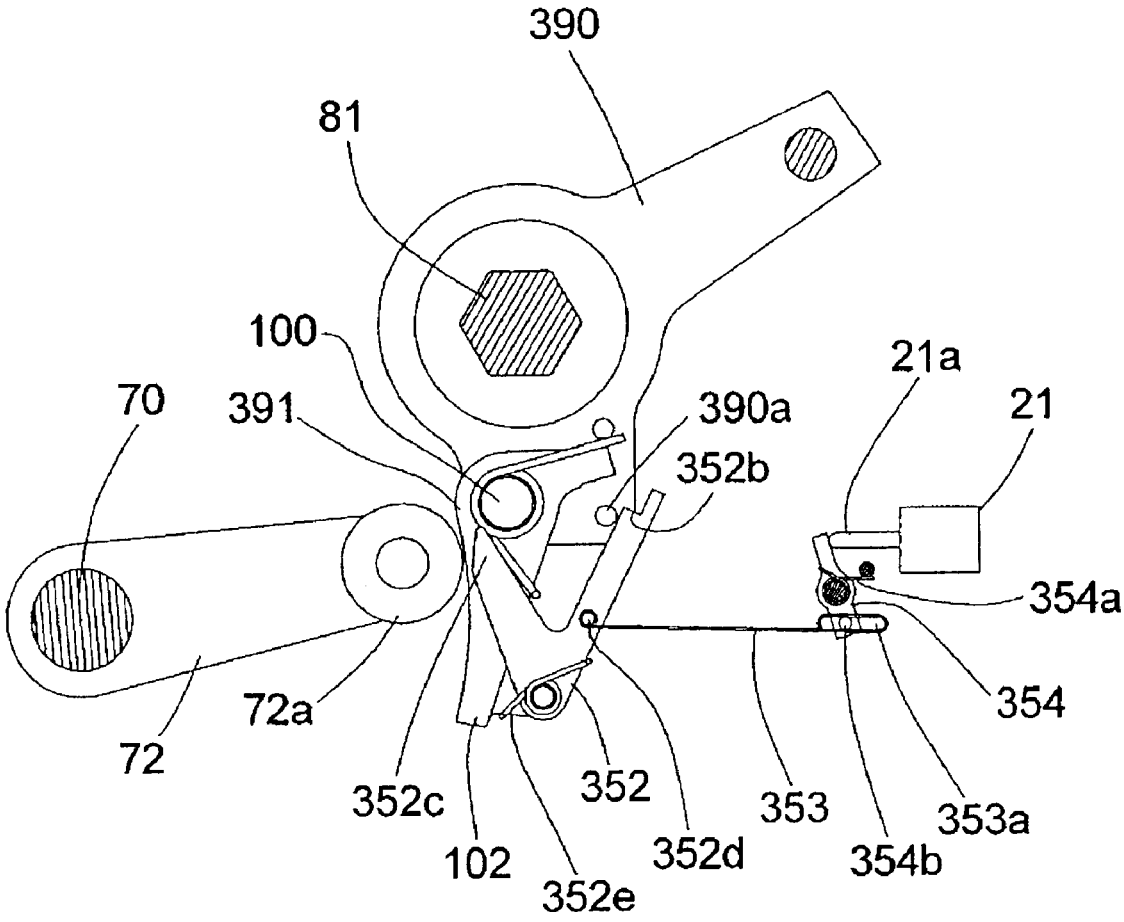
FIG. 12 is a front view of the main part of the switchgear of FIG. 8, which illustrates a cutoff operation process continued from FIG. 11.
Figure 13:
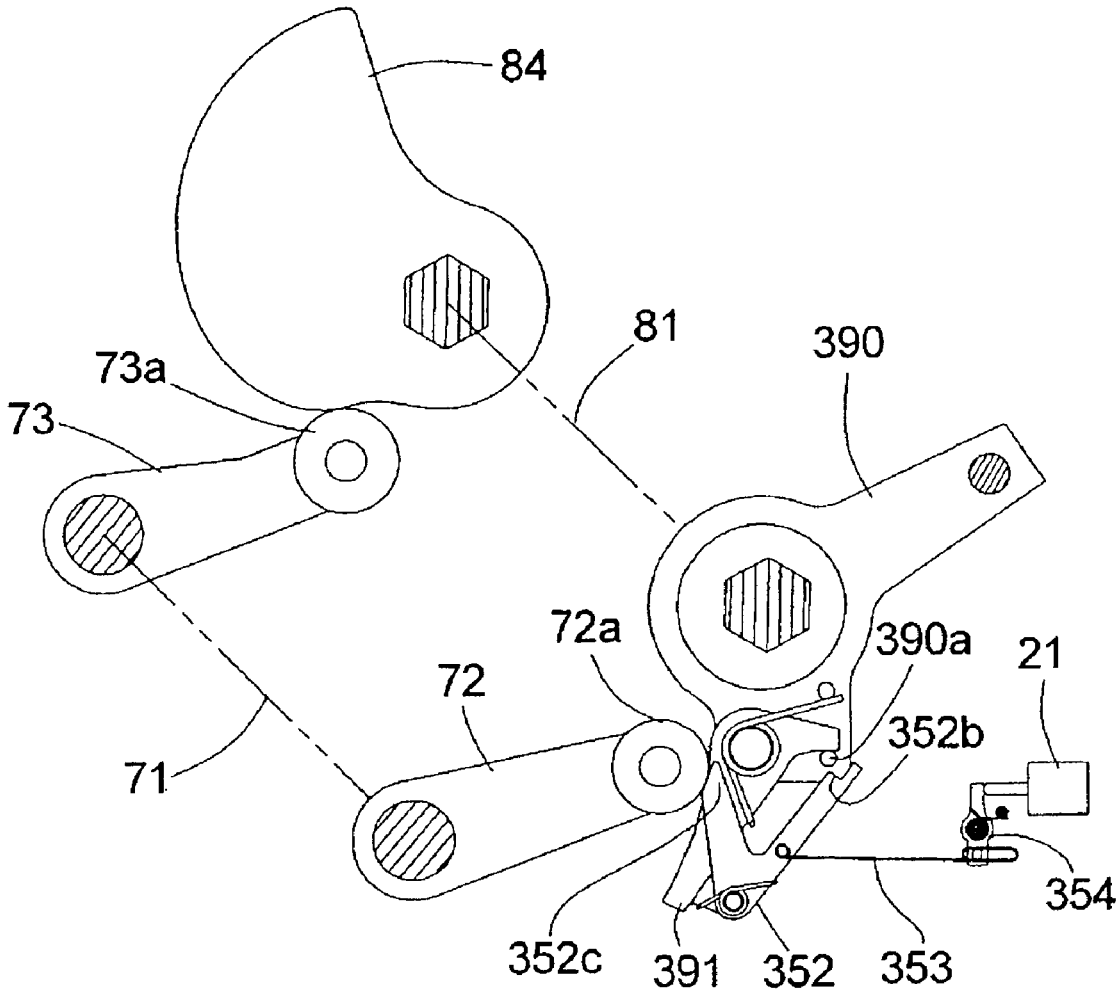
FIG. 13 is a front view of the main part of the switchgear of FIG. 8, which illustrates a closing operation process from the cutoff state to the closed state.
Figure 14:
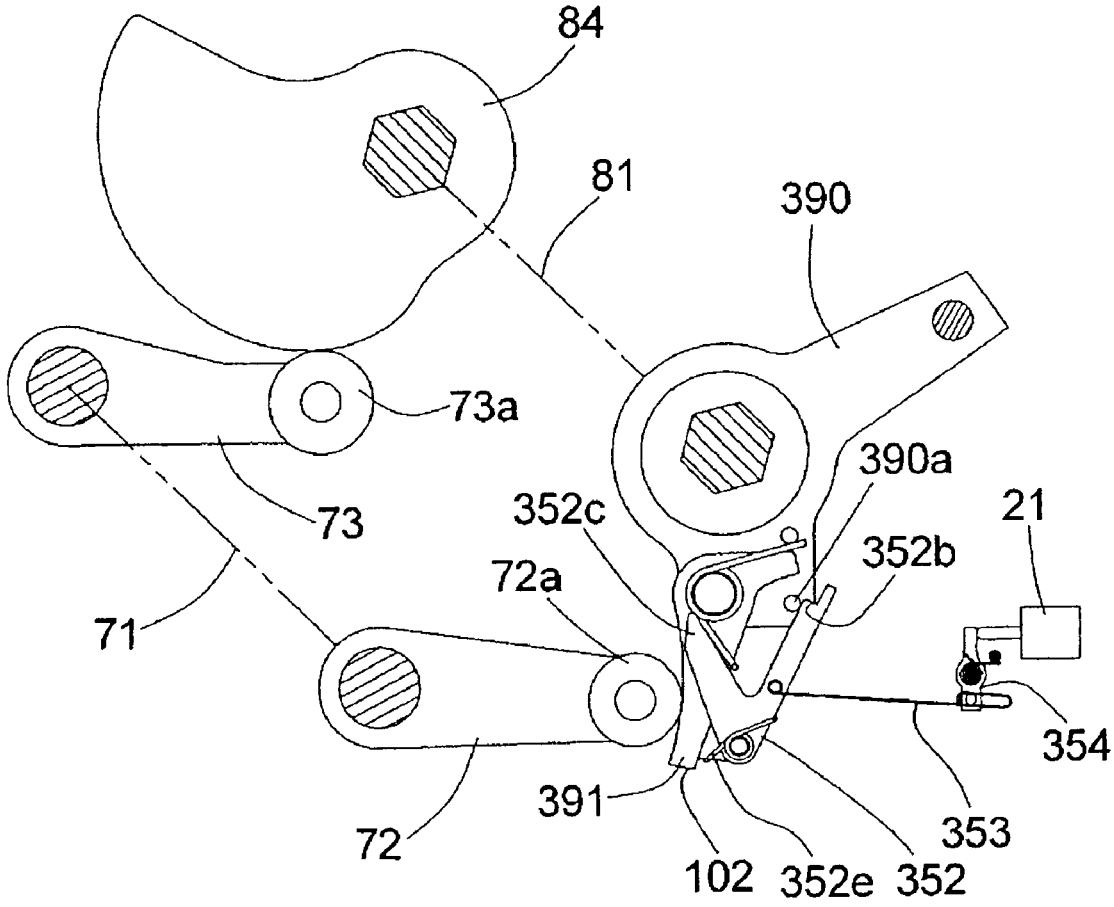
FIG. 14 is a front view of the main part of the switchgear of FIG. 8, which illustrates a closing operation process continued from FIG. 13.

First, with reference to FIGS. 8 to 14, a second embodiment of the switchgear operating mechanism according to the present invention will be described. FIG. 8 is a front view illustrating a closed state of a retention unit and a retention control unit of a switchgear operating mechanism. FIG. 9 is a view illustrating a cutoff state of a spring operating mechanism including the units illustrated in FIG. 8. FIG. 10 is a view illustrating a closed state of a spring operating mechanism including the units illustrated in FIG. 8. FIGS. 11 and 12 are views illustrating a cutoff operation process from the closed state to the cutoff state. FIGS. 13 and 14 are views illustrating a closing operation process from the cutoff state to the closed state.

In FIGS. 9 and 10, a movable contact 200 is connected to the left side of a link mechanism 6. When the link mechanism 6 is moved in the right direction as illustrated in FIG. 9, the movable contact 200 becomes "open" to achieve a cutoff state. On the other hand, when the link mechanism 6 is moved in the left direction as illustrated in FIG. 10, the movable contact becomes "closed" to achieve a closed state. One end of the link mechanism 6 is rotatably engaged with the leading end of a main lever 11, and the main lever 11 is rotatably fixed to a closing shaft 81. The closing shaft 81 is rotatably supported by a bearing (not illustrated) fixed to a frame (support structure) 14.

A cutoff spring 12 has one end fixed to an attachment surface 10*d* of the frame 14 and the other end fitted to a cutoff spring receiver 16. A damper 17 is fixed to the cutoff spring receiver 16. In the damper 17, a fluid is encapsulated and a piston 17*a* is provided so as to translationally slide. One end of the damper 17 is fixed to a cutoff spring link 15, which is rotatably attached to a pin 11*a* of the main lever 11.

A sub-shaft 70 is rotatably disposed relative to the frame 14, and a sub-lever 71 is fixed to the sub-shaft 70. A pin 71*a* is disposed at the leading end of the sub-lever 71. A pin 11*d* disposed on the main lever 11 and the pin 71*a* are connected by a main-sub connection link 80. A latch lever 72 is fixed to the sub-shaft 70, and a roller 72*a* is rotatably fitted to the leading end of the latch lever 72. Further, a cam lever 73 is fixed to the sub-shaft 70, and a roller 73*a* is rotatably fitted to the leading end of the cam lever 73.

A closing spring 13 has one end fixed to the attachment surface 10*d* of the frame 14 and the other end fixed to a closing spring receiver 18. A pin 18*a* is disposed on the closing spring receiver 18. The pin 18*a* is connected to a pin 82*a* of a closing lever 82 which is fixed to the end portion of the closing shaft 81 through a closing link 83. A closing cam 84 is fixed to the closing shaft 81 and releasably engaged with the roller 73*a* in accordance with the rotation of the closing shaft 81.

A tab 82*b* is disposed at one end of the closing lever 82 and is releasably engaged with a half-column portion 62*a* provided in an anchoring lever 62 for closing which is rotatably disposed on the frame 14. Further, a return spring 62*b* is disposed at one end of the anchoring lever 62 for closing. The other end of the return spring 62*b* is fixed to the frame 14. The return spring 62*b* is a compression spring and the spring force thereof always acts on the anchoring lever 62 for closing as a clockwise torque. However, the rotation of the anchoring lever 62 is restricted by an engagement between a plunger 22*a* of an electromagnetic solenoid 22 for closing, which is fixed to the frame 14, and the anchoring lever 62 for closing.

In the cutoff state illustrated in FIG. 9, the center 101 of the closing shaft 81 is displaced to the left relative to the center axis (or the axis connecting the centers of the pin 18*a* and the pin 82*a*) of the closing link 83, so that a counterclockwise torque is applied to the closing lever 82 by the closing spring 13. However, the rotation of the closing lever 82 is restricted by an engagement between the tab 82*b* and the half-column portion 62*a*.

A projecting support portion 390*b* is formed in an anchoring lever 390. The support portion 390*b* is engaged with a stopper 14*b* which is fixed to the frame 14, which fixes the position of the anchoring lever 390 relative to the frame 14.

A latch 391 is rotatably disposed around a latch axis pin 100 which is fixed to the end portion of the anchoring lever 390. A latch return spring 391*a* is disposed between the anchoring lever 390 and the latch 391. The latch return spring 391*a* always generates a clockwise torque for the latch 391. The clockwise rotation of the latch 391 is restricted by an abutment between a stopper pin (stopper) 390*a* disposed on the anchoring lever 390 and the latch 391. A leading end 102 of the latch 391 is formed by a substantially cylindrical surface, center position of the cylindrical surface substantially coincides with the rotation center of the latch 391, i.e., center axis of the latch axis pin 100 or falls within the radius of the latch axis pin 100.

A lock lever 352 is a V-shape plate and has, at its bent portion of the V-shape, a pin 352*a*, through which the lock lever 352 and the latch 391 are rotatably engaged with each other. An engagement portion 352*b* which is releasably engaged with the stopper pin 390*a* is formed at one end of the V-shape lock lever 352. A protrusion portion 352*c* to be described later is formed at the other end of the V-shape lock lever 352.

A counterclockwise torque is always applied to the lock lever 352 by a lock lever return spring 352*e*, and the lock lever 352 receives the torque when the engagement portion 352*b* abuts the stopper pin 390*a*.

In the closed state illustrated in FIGS. 8 and 10, the engagement portion 352*b* engages with the stopper pin 390*a* and the engagement state is retained by the lock lever return spring 352*e*. Therefore, counterclockwise rotation of the latch 391 is prevented by the presence of the lock lever 352 and the stopper pin 390*a*. A protrusion portion 352*c* is formed in the lock lever 352 and is releasably engaged with the roller 72*a*.

A pull-off link mechanism has a pull-off link 353 and a pull-off lever 354 movably and rotatably engaged with one end of the pull-off link 353. The pull-off link 353 has an elongated hole 353*a* which penetrates the engagement portion between itself and a pull-off lever pin 354*b* disposed on the pull-off lever 354. The pull-off lever pin 354*b* can be moved and rotated relative to the elongated hole 353*a* within the range of the elongated hole 353*a*. A lock lever pin 352*d* is disposed on the lock lever 352 and is rotatably engaged with the end portion of the pull-off link 353 at the opposite side to the elongated hole 353*a*. The pull-off lever 354 is rotatably disposed relative to the frame 14 and always receives a clockwise torque by a pull-off return spring 354*a*.

The leading end of a plunger 21*a* of an electromagnetic solenoid 21 for cutoff which is fixed to the frame 14 is releasably engaged with the pull-off lever 354, which causes the pull-off lever 354 to be rotated in the counterclockwise direction upon input of a cutoff command.

In the closed state, the main lever 11 always receives a clockwise torque by an expanding spring force of the cutoff spring 12. The force transmitted to the main lever 11 is then transmitted to the sub-lever 71 through the main-sub connection link 80. The transmitted force becomes a torque for always rotating the sub-lever 71 in the counterclockwise direction. This counterclockwise torque is supplied also to the latch lever 72. However, in the closed state, the leading end 102 of the latch 391 and the roller 72*a* are engaged with each other to restrict the counterclockwise rotation of the latch lever 72. Accordingly, the subsequent members from the sub-lever 71 to the cutoff spring 12 maintain their static state.

In the present embodiment, the rotation shafts, such as the closing shaft 81 and the sub-shaft 70, and the axes of the pins are parallel to each other.

(Cutoff Operation)

In the present embodiment having the configuration described above, a cutoff operation from the closed state illustrated in FIGS. 8 and 10, through states illustrated in FIGS. 11 and 12, to the cutoff state illustrated in FIG. 9 will be described. First, in the closed state illustrated in FIGS. 8 and 10, upon input of an external command, the electromagnetic solenoid 21 for cutoff is excited to move the plunger 21*a* in the direction of an arrow B. Since the pull-off lever 354 is engaged with the plunger 21*a*, it is rotated in the counterclockwise direction. In conjunction with the rotation, the pull-off link 353 is moved to the right while being engaged with the lock lever pin 352*d* to rotate the lock lever 352 in the clockwise direction. As a result, an engagement between the engagement portion 352*b* and the stopper pin 390*a* is released. This state is illustrated in FIG. 11.

The pull-off link 353 rotates the latch 391 in the counterclockwise direction through the lock lever 352, which releases an engagement between the roller 72*a* and the leading end 102 of the latch 391. The latch lever 72 receives a counterclockwise torque from the cutoff spring 12, so that it is rotated in the counterclockwise direction while pushing the latch 391. At this time, the pull-off link 353 moves while the elongated hole 353*a* and the pull-off lever pin 354*b* are engaged with each other, so that it operates independently of the pull-off lever 354. In this state, the protrusion portion 352*c* of the lock lever 352 has been shifted to the pull-off lever 354 side from the latch 391, so that it is not engaged with the roller 72*a*. This state is illustrated in FIG. 12.

FIG. 9 illustrates the end state of the cutoff operation. In this state, the lock lever 352 has been returned to substantially the same position as those in the closed state (FIGS. 8 and 10) by the lock lever return spring 352*e* (FIG. 1). Further, the pull-off link 353 and pull-off lever 354 have been returned to substantially the same position as those in the closed state by the pull-off return spring 354*a* (FIG. 8). Furthermore, the latch 391 has been returned to substantially the same position as that in the closed state by the latch return spring 391*a*.

When an engagement between the latch 391 and the roller 72*a* is released in FIG. 10, the cam lever 73 and the sub-lever 71, which are fixed to the latch lever 72 and the sub-shaft 70, are rotated in the counterclockwise direction (denoted by arrows C and D). Then, the main lever 11 is rotated in the clockwise direction (denoted by an arrow E) to cause the cutoff spring 12 and the damper 17 to be moved in the direction of an arrow F. Then, the link mechanism 6 and the movable contact 200 connected to the link mechanism 6 are moved to the right to start the cutoff operation.

When the cutoff spring 12 is displaced by a given distance, the piston 17*a* abuts the stopper 14*a* fixed to the frame 14 to generate a braking power of the damper 17 to thereby stop the movement of the cutoff spring 12. The movements of the link levers connected to the cutoff spring 12 are accordingly stopped, thereby completing the cutoff operation. This state is illustrated in FIG. 9.

(Closing Operation)

Next, a closing operation from the cutoff state illustrated in FIG. 9, through states illustrated in FIGS. 13 and 14, to the closed state illustrated in FIGS. 8 and 10 will be described.

FIG. 9 illustrates a state where the closing spring 13 accumulates energy in the cutoff state. Upon input of an external command, the electromagnetic solenoid 22 for closing is excited to move the plunger 22*a* in the direction of an arrow H. The anchoring lever 62 for closing is engaged with the plunger 22*a*, so that it is rotated in the counterclockwise direction. Then, the engagement between the half-column portion 62*a* and the tab 82*b* is released. Accordingly, the closing lever 82 and the closing shaft 81 are rotated in the counterclockwise direction (denoted by an arrow I) by a spring force of the closing spring 13. The closing spring 13 is stretched in the direction of an arrow J and discharges its accumulated energy. The closing cam 84 fixed to the closing shaft 81 is rotated in the direction of an arrow K to be engaged with the roller 73*a*. When the roller 73*a* is pushed by the closing cam 84, the cam lever 73 is rotated in the clockwise direction (denoted by an arrow L) and, at the same time, the sub-lever 71 is rotated in the direction of an arrow M.

When the rotation of the sub-lever 71 is transmitted to the main lever 11, the main lever 11 is rotated in the counterclockwise direction (denoted by an arrow N). Then, the link mechanism 6 and the movable contact 200 connected thereto are moved to the left to start the closing operation. The cutoff spring 12 is compressed in association with the rotation of the main lever 11 to accumulate energy to establish an engagement between the roller 72*a* and the latch 391 once again, thereby completing the closing operation.

When the latch lever 72 is rotated in the clockwise direction in a state where the operation is shifted from the cutoff state illustrated in FIG. 9 to the closing operation, the roller 72*a* is engaged with the protrusion portion 352*c* of the lock lever 352 in the first place. This engagement causes the lock lever 352 to be rotated in the clockwise direction. This releases an engagement between the engagement portion 352*b* of the lock lever 352 and the stopper pin 390*a*, allowing the counterclockwise rotation of the latch 391. This state is illustrated in FIG. 13.

FIG. 14 illustrates a state where the latch 391 is rotated further in the counterclockwise direction by the roller 72*a*. FIGS. 8 and 10 illustrate a state where the closing operation has been completed.

When an engagement between the closing cam 84 and the roller 73*a* is released, the roller 72*a* is engaged with the leading end 102 of the latch 391 once again by the expanding force of the cutoff spring 12. At this reengagement operation, a force acting from the roller 72*a* to the latch 391 is directed to substantially the rotation center of the latch 391. This is because that the leading end 102 of the latch 391 is formed by a substantially cylindrical surface, and the center position of the cylindrical surface substantially coincides with the rotation center of the latch 391 (i.e., center axis of the latch axis pin 100). However, there is a possibility that the latch 391 is rotated in the counterclockwise direction due to lack of accuracy in the engagement surface, deformation of the engagement surface, or impact force at the time of engagement, to release the roller 72*a* from the latch 391. At this time, however, an engagement between the engagement portion 352*b* of the lock lever 352 and the stopper pin 390*a* have already been established by the lock lever return spring 352*e*, the lock lever 352 functions as a malfunction preventing mechanism to prevent the counterclockwise rotation of the latch 391.

According to the present embodiment, after the electromagnetic solenoid 21 for cutoff is excited upon input of a cutoff command, the cutoff operation is completed by two operation steps: a first operation step in which the latch 391 is directly driven through the pull-off lever 354 and pull-off link 353 to release an engagement between the latch 391 and the roller 72*a*; and a second operation step in which the cutoff spring 12 operates. As described above, the number of operation steps for completing the cutoff operation is reduced from three (in the case of conventional spring operating mechanism) to two, thereby significantly reducing the cutoff operation time. This means that T2 is removed from the expression (1) representing the contact opening time, so that it is possible to reduce the contact opening time.

Further, the lock lever 352 can prevent a disengagement of the latch 391 due to an external vibration or a change in the retention direction resulting from deformation of the leading end 102 of the latch 391, thereby increasing operational reliability of the spring operating mechanism.

Furthermore, the engagement surface of the leading end 102 of the latch 391 is formed by a substantially cylindrical surface, and the center position of the cylindrical surface substantially coincides with the rotation center of the latch (i.e., center axis of the latch axis pin 100), so that a torque of the roller 72*a* does not act on the latch 391 in the closed state. This allows size reduction of the latch 391 to thereby minimize a force required for releasing the engagement between the latch 391 and the roller 72*a*, which can minimize the size of the electromagnetic solenoid.

Further, by forming the protrusion portion 352*c* in the lock lever 352 and engaging the protrusion portion 352*c* with the roller 72*a* at the time of the closing, it is possible to realize an action for easily releasing an engagement between the engagement portion 352*b* of the lock lever 352 and the stopper pin 390*a* with a simple structure, contributing to size reduction of the latch 391.

Third Embodiment

Figure 15:
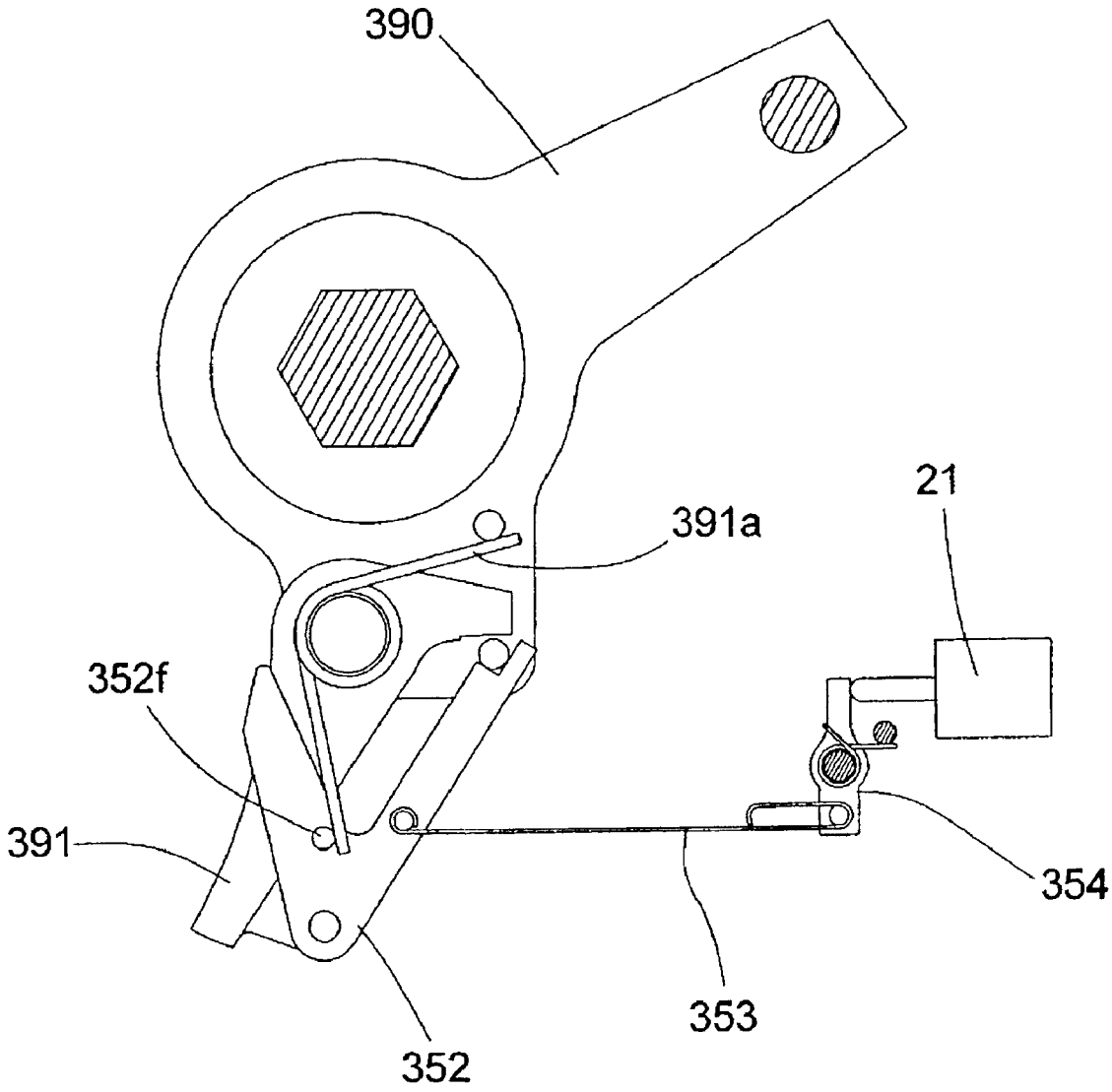
FIG. 15 is a front view illustrating a closed state of a retention unit and a retention control unit of a switchgear operating mechanism according to a third embodiment of the present invention.
Figure 16:
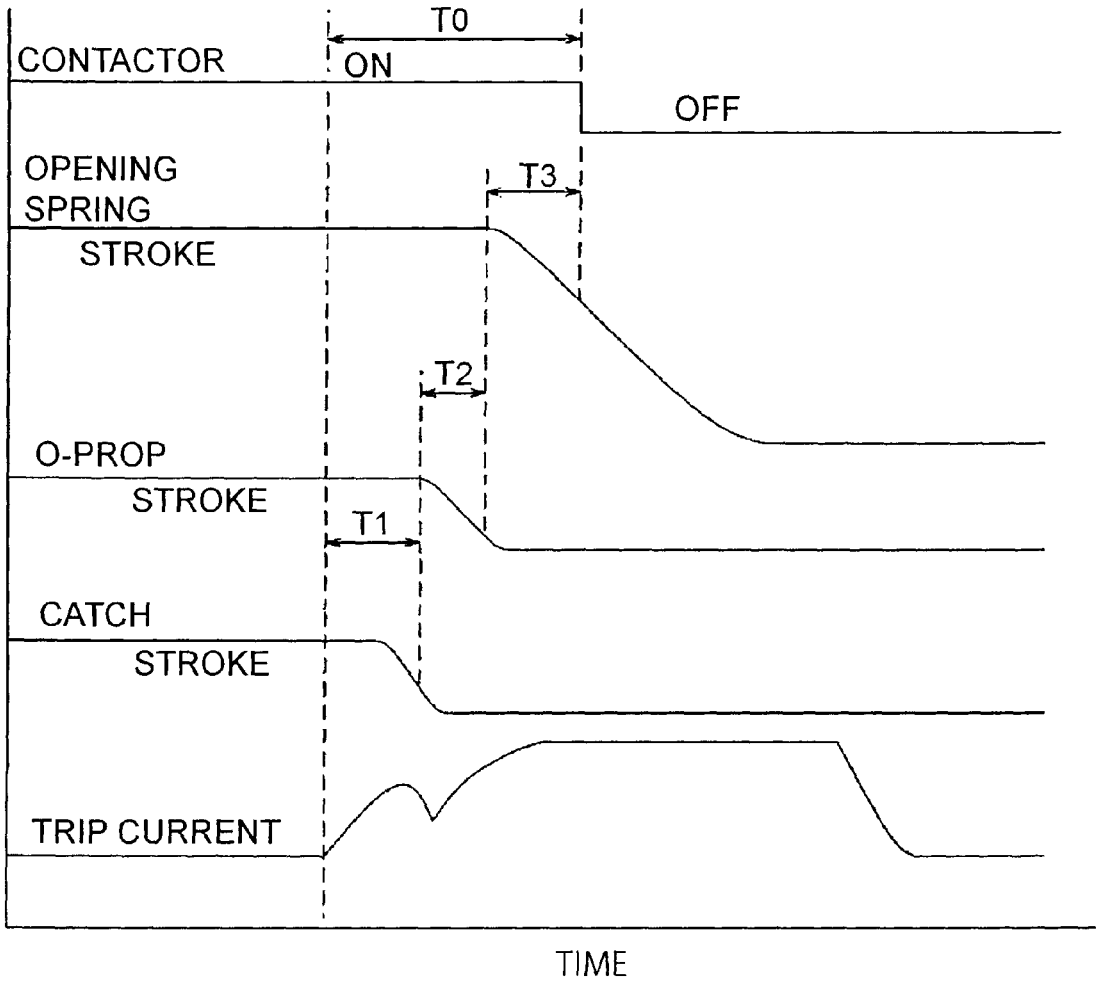
FIG. 16 is a time chart for explaining the cutoff operation of a conventional switchgear.

Next, with reference to FIG. 15, a third embodiment of the switchgear operating mechanism according to the present invention will be described. The third embodiment is a modification of the second embodiment, and the same reference numerals as those in the second embodiment denote the same or corresponding parts as those in the second embodiment, and the repetitive description is omitted.

The present embodiment is obtained by omitting the lock lever return spring 352*e* of FIG. 8 and partly modifying the lock lever 352. More specifically, as illustrated in FIG. 15, a return spring pin 352*f* is disposed in the lock lever 352, and one end of a latch return spring 391*a* is engaged with the return spring pin 352*f*. As a result, the latch 391 is biased in the clockwise direction through the lock lever 352, and the lock lever 352 is biased in the counterclockwise direction.

With the above configuration, it is possible to obtain the same effect as that in the second embodiment.

Other Embodiments

The embodiments described above are merely given as examples, and it should be understood that the present invention is not limited thereto. For example, although compression coil springs are used as the cutoff spring 12 and the closing spring 13 in the above embodiments, other elastic bodies, such as torsion coil springs, disc springs, spiral springs, plate springs, air springs, and the expanding springs may be used alternatively. Further, although coil springs or torsion coil springs are used as the return springs 91*a*, 52*c*, 54*a*, 391*a*, 352*e*, and 354*a* provided in the latches 91, 391, lock levers 52, 352 and the pull-off levers 54, 354, other elastic bodies such as disc springs, spiral springs, or plate springs may be used alternatively.

The present invention can also be applied to an apparatus having a plurality of cutoff springs or plurality of the closing springs.

Further, although the stopper pin (90*a*, 390*a*) for restricting the rotation of the lock lever (52, 352) also serves as a stopper for restricting the rotation of the latch (91, 391), in the above embodiments, the above functions may be provided separately.

Further, since the anchoring levers 90, 390 are fixed to the frame 14, they may be omitted. In this case, the stoppers 90*a*, 390*a* or the like are directly fixed to the frame 14. Further, the stoppers 90*a*, 390*a* may be integrated with the anchoring levers 90, 390 or the frame 14.

What is claimed is:

1. A switchgear operating mechanism for reciprocatively driving a movable contact of a switchgear so as to shift the switchgear between a cutoff state and a closed state, the operating mechanism comprising:

a frame;

a closing shaft which is rotatably disposed relative to the frame;

a main lever which is rotatably fixed to the closing shaft and which can be swung in conjunction with the movable contact;

a cutoff spring which is disposed such that it accumulates energy when the switchgear operating state is shifted from the cutoff state to the closed state in accordance with rotation of the closing shaft while it discharges its accumulated energy when the switchgear operating state is shifted from the closed state to the cutoff state;

a sub-shaft which is rotatably disposed relative to the frame so as to be positioned around a rotation axis substantially parallel to a rotation axis of the closing shaft;

a sub-lever which is swingably fixed to the sub-shaft;

a main-sub connection link which rotatably connects a leading end of the sub-lever and the main lever;

a cam mechanism which swings the sub-shaft in accordance with a rotation of the closing shaft;

a latch lever which is swingably fixed to the sub-shaft;

a roller which is rotatably fixed to a leading end of the latch lever;

a latch which is disposed so as to be rotated relative to the frame around a rotation axis substantially parallel to the rotation axis of the closing shaft;

a kick lever which is disposed so as to be rotated relative to the latch around a rotation axis substantially parallel to the rotation axis of the latch and has a through hole therein;

a lock lever which is disposed so as to be rotated relative to the latch around a different rotation axis substantially parallel to the rotation axis of the latch;

a latch return spring which biases the latch so as to rotate the latch in a predetermined direction;

a lock return spring which biases the lock lever and the kick lever so as to rotate the lock lever and the kick lever in a predetermined direction;

a stopper which is fixed to the frame so as to restrict the rotation of the biasing direction of the lock lever and the latch; and a connection pin which is attached to the lock lever so as to be moved and rotated in the through hole formed in the lock lever relative to the through hole, wherein in the closed state, the roller pushes the leading end of the latch in an opposite direction to the biasing direction of the latch return spring and causes the leading end of the lock lever to be engaged with the stopper to stop the operation of the latch, and in a state where the switchgear operating state is shifted from the closed state to the cutoff state, the lock lever is pulled so as to be rotated in an opposite direction to the biasing direction of the lock return spring and the latch is pulled in an opposite direction to the biasing direction of the latch return spring to release an engagement between the roller and the leading end of the latch, which causes the cutoff spring to discharge its energy to rotate the sub-shaft and the main lever.

2. The switchgear operating mechanism according to claim 1, wherein the hole formed in the kick lever has a rectangular shape, and the connection pin disposed on the lock lever is engaged with surface of the hole at side of the rotation axis of the kick lever in the closing state.

3. The switchgear operating mechanism according to claim 1, further comprising:

a pull-off link mechanism which is engaged with the lock lever;

a pull-off return spring for biasing the pull-off link mechanism in a predetermined direction; and an electromagnetic solenoid for cutoff which drives the pull-off link mechanism against the biasing force of the pull-off return spring to pull the lock lever so as to shift the switchgear operating state from the closed state to the cutoff state.

4. The switchgear operating mechanism according to claim 3, wherein the kick lever has a protrusion portion, and in a state where the switchgear operating state is shifted from the cutoff state to the closing state, the latch lever is rotated in a direction opposite to the biasing direction of the latch return spring by the cam mechanism in association with the rotation of the closing shaft to cause the roller to push the protrusion portion, allowing the kick lever to be rotated and the hole to be engaged with the connection pin of the lock lever to rotate the lock lever in an opposite direction to the biasing direction of the lock return spring to release an engagement between the lock lever and the stopper, allowing the latch lever to be further rotated, causing the latch to be rotated in a direction opposite to the biasing direction of the latch return spring to allow the leading end of the latch to abut the roller, shifting the switchgear operating state to the closing state.

5. The switchgear operating mechanism according to claim 4, wherein a pin is disposed on the lock lever, the pull-off link mechanism has a pull-off link connected to the pin so as to be rotated relative to the pin and a pull-off lever which is engaged with an elongated hole formed in the pull-off link, and when the electromagnetic solenoid for cutoff pushes the pull-off lever, the pull-off lever is rotated in a direction opposite to the biasing direction of the lock return spring.

6. The switchgear operating mechanism according to claim 1, wherein an engagement surface of the latch with the roller is formed in a substantially cylindrical surface, and the axis of the cylindrical surface substantially coincides with the rotation axis of the latch.

7. The switchgear operating mechanism according to claim 1, wherein a cylindrical latch axis pin for allowing rotation of the latch is disposed at a position corresponding to the rotation axis of the latch, an engagement surface of the latch with the roller is formed in a substantially cylindrical surface, and an axis of the cylindrical surface falls within a range between the rotation center of the latch axis pin and position spaced from the center of the latch axis pin on the stopper side by a distance corresponding to the radius of the latch axis pin.

8. The switchgear operating mechanism according to claim 1, further comprising a closing spring which is disposed such that it accumulates energy in the closing state or the cutoff state in accordance with the rotation of the closing shaft while it discharges its accumulated energy when the switchgear operating state is shifted from the cutoff state to the closed state.

9. The switchgear operating mechanism according to claim 8, comprising:

a closing lever which is fixed to the closing shaft; and a closing link which is rotatably connected to the closing lever, wherein the closing spring is disposed between the leading end of the closing link and the frame so as to bias the leading end of the closing link in a direction away from the closing shaft.

10. A switchgear operating mechanism for reciprocatively driving a movable contact of a switchgear so as to shift the switchgear between a cutoff state and a closed state, the operating mechanism comprising:

a frame;

a closing shaft which is rotatably disposed relative to the frame;

a main lever which is rotatably fixed to the closing shaft and which can be swung in conjunction with the movable contact;

a cutoff spring which is disposed such that it accumulates energy when the switchgear operating state is shifted from the cutoff state to the closed state in accordance with rotation of the closing shaft while it discharges its accumulated energy when the switchgear operating state is shifted from the closed state to the cutoff state;

a sub-shaft which is rotatably disposed relative to the frame so as to be positioned around a rotation axis substantially parallel to a rotation axis of the closing shaft;

a sub-lever which is swingably fixed to the sub-shaft;

a main-sub connection link which rotatably connects a leading end of the sub-lever and the main lever;

a cam mechanism which swings the sub-shaft in accordance with a rotation of the closing shaft;

a latch lever which is swingably fixed to the sub-shaft;

a roller which is rotatably fixed to a leading end of the latch lever;

a latch which is disposed so as to be rotated relative to the frame around a rotation axis substantially parallel to the rotation axis of the closing shaft;

a lock lever which is disposed so as to be rotated relative to the frame around a rotation axis substantially parallel to the rotation axis of the latch;

a latch return spring which biases the latch so as to rotate the latch in a predetermined direction;

a lock lever return spring which biases the lock lever in a direction opposite to the biasing direction of the latch return spring; and a stopper which is fixed to the frame so as to restrict the rotation of the biasing direction of the lock lever return spring of the lock lever, wherein in the closed state, the roller pushes the leading end of the latch in a direction opposite to the biasing force of the latch return spring, and in a state where the switchgear operating state is shifted from the closed state to the cutoff state, the lock lever is pulled so as to allow the latch to be rotated in an opposite direction to the biasing direction of the latch return spring to release an engagement between the roller and the leading end of the latch, which causes the cutoff spring to discharge its energy to rotate the sub-shaft.

11. The switchgear operating mechanism according to claim 10, wherein an engagement surface between the lock lever and stopper is formed in a substantially cylindrical surface, and the axis of the cylindrical surface substantially coincides with the rotation axis of the lock lever.

12. The switchgear operating mechanism according to claim 10, wherein a cylindrical pin for allowing rotation of the lock lever is disposed at the position corresponding to the rotation axis of the lock lever, an engagement surface between the lock lever and the stopper is formed in a substantially cylindrical surface, and the axis of the cylindrical surface falls within the radius of the pin.

13. The switchgear operating mechanism according to claim 10, further comprising:

a pull-off link mechanism which is engaged with the lock lever;

a pull-off return spring for biasing the pull-off link mechanism in a predetermined direction; and an electromagnetic solenoid for cutoff which drives the pull-off link mechanism against the biasing force of the pull-off return spring to pull the lock lever so as to shift the switchgear operating state from the closed state to the cutoff state.

14. The switchgear operating mechanism according to claim 13, wherein the lock lever has a lock lever protrusion portion, and in a state where the switchgear operating state is shifted from the cutoff state to the closing state, the latch lever is rotated in a direction opposite to the biasing direction of the lock lever return spring by the cam mechanism in association with the rotation of the closing shaft to cause the roller to push the lock lever protrusion portion, allowing the lock lever to be rotated and the latch lever to be further rotated, causing the latch to be rotated in a direction opposite to the biasing direction of the latch return spring to allow the leading end of the latch to abut the roller, shifting the switchgear operating state to the closing state.

15. The switchgear operating mechanism according to claim 14, wherein one end of the latch return spring is engaged with a return spring pin disposed on the lock lever, which biases the lock lever in such a direction that the lock lever is engaged with the stopper.

16. The switchgear operating mechanism according to claim 13, wherein a lock lever pin is disposed on the lock lever, the pull-off link mechanism has a pull-off link having a hole connected to the lock lever pin so as to be rotated relative to the lock lever pin and a pull-off lever including a pull-off lever pin which is formed at another end of the pull-off link, and when the electromagnetic solenoid for cutoff pushes the pull-off lever, the pull-off lever is rotated in a direction opposite to the biasing direction of the lock lever return spring.

17. The switchgear operating mechanism according to claim 10, wherein an engagement surface of the latch with the roller is formed in a substantially cylindrical surface, and the axis of the cylindrical surface substantially coincides with the rotation axis of the latch.

18. The switchgear operating mechanism according to claim 10, wherein a cylindrical latch axis pin for allowing rotation of the latch is disposed at a position corresponding to the rotation axis of the latch, an engagement surface of the latch with the roller is formed in a substantially cylindrical surface, and an axis of the cylindrical surface falls within a range between the rotation center of the latch axis pin and position spaced from the center of the latch axis pin on the stopper side by a distance corresponding to the radius of the latch axis pin.

19. The switchgear operating mechanism according to claim 10, further comprising a closing spring which is disposed such that it accumulates energy in the closing state or the cutoff state in accordance with the rotation of the closing shaft while it discharges its accumulated energy when the switchgear operating state is shifted from the cutoff state to the closed state.

20. A switchgear having a movable contact that can be moved in a reciprocating manner and an operating mechanism that reciprocatively drives the movable contact and configured to be shifted between a cutoff state and a closed state by the movement of the movable contact, the operating mechanism comprising:

a frame;

a closing shaft which is rotatably disposed relative to the frame;

a main lever which is rotatably fixed to the closing shaft and which can be swung in conjunction with the movable contact;

a cutoff spring which is disposed such that it accumulates energy when the switchgear operating state is shifted from the cutoff state to the closed state in accordance with rotation of the closing shaft while it discharges its accumulated energy when the switchgear operating state is shifted from the closed state to the cutoff state;

a sub-shaft which is rotatably disposed relative to the frame so as to be positioned around a rotation axis substantially parallel to a rotation axis of the closing shaft;

a sub-lever which is swingably fixed to the sub-shaft;

a main-sub connection link which rotatably connects a leading end of the sub-lever and the main lever;

a cam mechanism which swings the sub-shaft in accordance with a rotation of the closing shaft;

a latch lever which swingably fixed to the sub-shaft;

a roller which is rotatably fixed to a leading end of the latch lever;

a latch which is disposed so as to be rotated relative to the frame around a rotation axis substantially parallel to the rotation axis of the closing shaft;

a kick lever which is disposed so as to be rotated relative to the latch around a rotation axis substantially parallel to the rotation axis of the latch;

a lock lever which is disposed so as to be rotated relative to the latch around a different rotation axis substantially parallel to the rotation axis of the latch;

a latch return spring which biases the latch so as to rotate the latch in a predetermined direction;

a lock return spring which biases the lock lever and the kick lever so as to rotate the lock lever and the kick lever in a predetermined direction;

a stopper which is attached to the frame so as to restrict the rotation of the biasing direction of the lock lever and the latch; and a hole disposed in the kick lever so as to be engaged with a pin disposed on the lock lever, wherein in the closed state, the roller pushes the leading end of the latch in an opposite direction to the biasing direction of the latch return spring and causes the leading end of the lock lever to be engaged with the stopper to stop the operation of the latch, and in a state where the switchgear operating state is shifted from the closed state to the cutoff state, the lock lever is pulled so as to allow the lock lever to be rotated in an opposite direction to the biasing direction of the lock return spring and the latch is pulled in an opposite direction to the biasing direction of the latch return spring to release an engagement between the roller and the leading end of the latch, which causes the cutoff spring to discharge its energy to rotate the sub-shaft and the main lever.

21. A switchgear having a movable contact that can be moved in a reciprocating manner and an operating mechanism that reciprocatively drives the movable contact and configured to be shifted between a cutoff state and a closed state by the movement of the movable contact, the operating mechanism comprising:

a frame;

a closing shaft which is rotatably disposed relative to the frame;

a main lever which is rotatably fixed to the closing shaft and which can be swung in conjunction with the movable contact;

a cutoff spring which is disposed such that it accumulates energy when the switchgear operating state is shifted from the cutoff state to the closed state in accordance with rotation of the closing shaft while it discharges its accumulated energy when the switchgear operating state is shifted from the closed state to the cutoff state;

a sub-shaft which is rotatably disposed relative to the frame so as to be positioned around a rotation axis substantially parallel to a rotation axis of the closing shaft;

a sub-lever which is swingably fixed to the sub-shaft;

a main-sub connection link which rotatably connects a leading end of the sub-lever and the main lever;

a cam mechanism which swings the sub-shaft in accordance with a rotation of the closing shaft;

a latch lever which swingably fixed to the sub-shaft;

a roller which is rotatably fixed to a leading end of the latch lever;

a latch which is disposed so as to be rotated relative to the frame around a rotation axis substantially parallel to the rotation axis of the closing shaft;

a lock lever which is disposed so as to be rotated relative to the frame around a rotation axis substantially parallel to the rotation axis of the latch;

a latch return spring which biases the latch so as to rotate the latch in a predetermined direction;

a lock lever return spring which biases the lock lever in a direction opposite to the biasing direction of the latch return spring; and a stopper which is fixed to the frame so as to restrict the rotation of the biasing direction of the lock lever return spring of the lock lever, wherein in the closed state, the roller pushes the leading end of the latch in a direction opposite to the biasing force of the latch return spring, and in a state where the switchgear operating state is shifted from the closed state to the cutoff state, the lock lever is pulled so as to allow the latch to be rotated in an opposite direction to the biasing direction of the latch return spring to release an engagement between the roller and the leading end of the latch, which causes the cutoff spring to discharge its energy to rotate the sub-shaft.

* * * * *